US010487426B2

(12) United States Patent
Kaneda et al.

(10) Patent No.: US 10,487,426 B2
(45) Date of Patent: Nov. 26, 2019

(54) TUBULAR FABRIC, METHOD OF KNITTING TUBULAR FABRIC, AND SOCK

(71) Applicant: OKAMOTO Corporation, Nara (JP)

(72) Inventors: Masatoshi Kaneda, Nara (JP); Takao Fukui, Nara (JP)

(73) Assignee: OKAMOTO CORPORATION, Nara (JP)

( * ) Notice: Subject to any disclaimer, the term of this patent is extended or adjusted under 35 U.S.C. 154(b) by 215 days.

(21) Appl. No.: 15/723,147

(22) Filed: Oct. 2, 2017

(65) Prior Publication Data

US 2018/0094367 A1 Apr. 5, 2018

(30) Foreign Application Priority Data

Oct. 3, 2016 (JP) ..... 2016-195954

(51) Int. Cl.

| | |
|---|---|
| ***D04B 9/46*** | (2006.01) |
| ***D04B 15/14*** | (2006.01) |
| ***D04B 1/10*** | (2006.01) |
| ***D04B 1/26*** | (2006.01) |
| ***D04B 9/56*** | (2006.01) |
| *A41B 11/00* | (2006.01) |

(52) U.S. Cl.

CPC ..... *D04B 9/46* (2013.01); *D04B 1/108* (2013.01); *D04B 1/26* (2013.01); *D04B 9/56* (2013.01); *D04B 15/14* (2013.01); *A41B 11/00* (2013.01); *A41B 2500/10* (2013.01)

(58) Field of Classification Search

CPC . D04B 9/46; D04B 1/108; D04B 1/26; D04B 9/56; D04B 15/14; D04B 11/34; D04B 11/28

See application file for complete search history.

(56) References Cited

U.S. PATENT DOCUMENTS 2,050,535 A * 8/1936 Martel ..... D04B 1/18 66/178 R
2,102,368 A * 12/1937 Martel ..... D04B 1/18 66/182

(Continued)

FOREIGN PATENT DOCUMENTS

JP 06-346301 12/1994
JP 07-150401 6/1995

(Continued)

*Primary Examiner* — Danny Worrell
(74) *Attorney, Agent, or Firm* — Kristina Castellano; Castellano PLLC

(57) ABSTRACT

A bent part of a sock has (i) a bulging part having a first bulging region which includes a region in which the number of wales decreases, and a second bulging region which includes a region in which the number of wales increases and (ii) an extended part having a first extended region in which the number of wales increases, and a second extended region in which the number of wales decreases. The extended part is located so as to be closer to a bend direction side than the bulging part. The extended part has a boundary part between the first extended region and the second extended region which boundary part has a bend direction side first end. The bend direction side first end is located on a center line in a direction in which a width of the sock extends, or within a predetermined distance from the center line.

11 Claims, 16 Drawing Sheets

(56) References Cited

U.S. PATENT DOCUMENTS

| | | | | |
|---|---|---|---|---|
| 5,103,656 | A * | 4/1992 | Hanson, II | A41B 11/003 2/239 |
| 7,562,541 | B2 * | 7/2009 | Hermanson | A61F 13/08 66/186 |
| 7,775,069 | B1 * | 8/2010 | Hermanson | D04B 1/265 66/186 |
| 7,971,280 | B2 * | 7/2011 | Kaneda | A41B 11/02 2/239 |
| 8,495,765 | B2 * | 7/2013 | Araki | A61F 13/064 2/240 |
| 8,603,019 | B1 * | 12/2013 | Hermanson | D04B 1/265 602/60 |
| 9,192,200 | B2 * | 11/2015 | Matsuo | A41D 13/06 |
| 10,011,926 | B2 * | 7/2018 | Gaither | A61F 13/08 |
| 2003/0230121 | A1 * | 12/2003 | Yokoyama | A41B 11/003 66/178 A |
| 2013/0205839 | A1 * | 8/2013 | Fukui | D04B 1/02 66/185 |

FOREIGN PATENT DOCUMENTS

| | | |
|---|---|---|
| JP | 2003-119601 | 4/2003 |
| JP | 2004-204378 | 7/2004 |
| JP | 2011-144467 | 7/2011 |

* cited by examiner

TUBULAR FABRIC, METHOD OF KNITTING TUBULAR FABRIC, AND SOCK

This Nonprovisional application claims priority under 35 U.S.C. § 119(a) on Patent Application No. 2016-195954 filed in Japan on Oct. 3, 2016, the entire contents of which are hereby incorporated by reference.

TECHNICAL FIELD

The present invention relates to a tubular fabric which is less likely to wrinkle on a bend direction side of a bent part of the tubular fabric.

BACKGROUND ART

Legs of a human being and socks differ in shape. Socks that are worn by a human being wrinkle in anterior parts of ankle joints of the human being. Specifically, foot parts (parts lower than ankles) and lower leg parts (parts upper than malleoli) of legs of a human being in an upright position are substantially at right angles. In view of this, in a case where the human being stands upright while wearing socks each of which is knitted so that a first part of the sock which first part surrounds a foot part and a second part of the sock which second part surrounds a lower leg part form therebetween an angle of more than 90°, the socks become loose in anterior parts of ankle joints, i.e., on instep sides, and wrinkle. This wrinkling (i) causes the human being who is wearing the socks to have a worse feel and (ii) impairs appearance of the socks. Such a problem causes a demand for socks which fit the shape of feet of a human being wearing the socks and which do not wrinkle in anterior parts of ankle joints.

Figure 17:
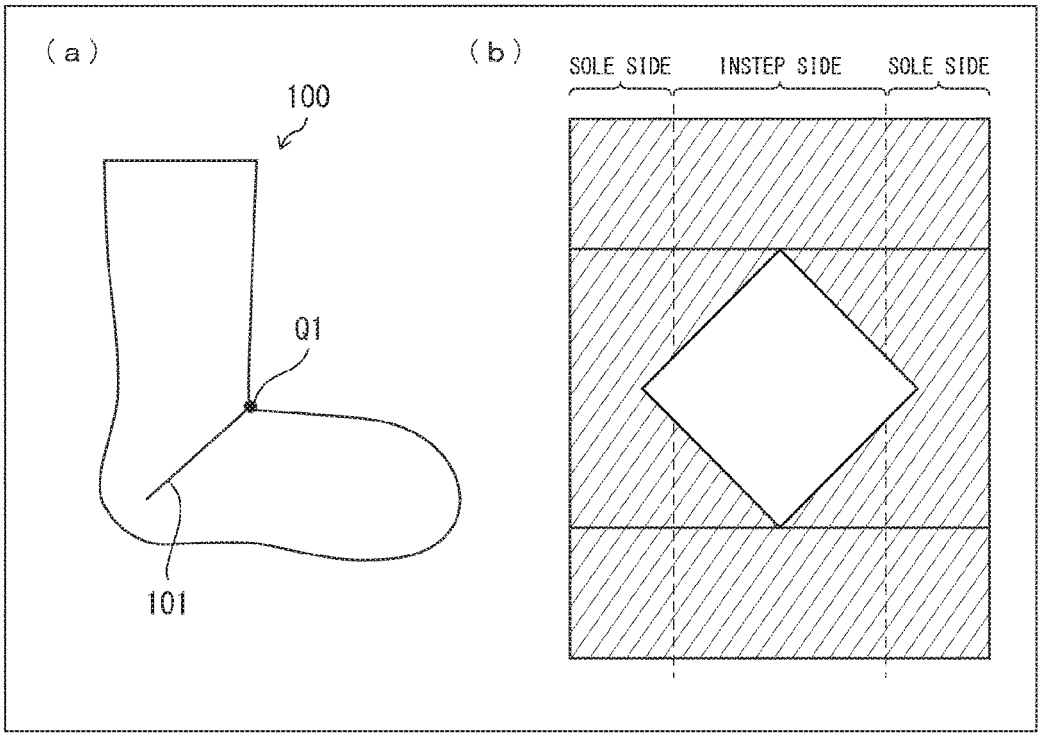

Patent Literature 1 discloses a sock which is knitted by use of a special knitting machine and which has a gore line whose length is adjusted so that the sock is bent at a desired angle made between a leg part and a foot part of the sock. (a) and (b) of FIG. 17 are views each illustrating a sock 100, which is an example of a conventional sock. (a) of FIG. 17 is a right side view of the sock 100. (b) of FIG. 17 is a development of the sock 100. The sock disclosed in Patent Literature 1 is the sock 100 which has a gore line 101 extending from (i) a point on the sock 100 which point is closer to an instep side of a foot than to a sole side end part of the foot to (ii) a point Q1 on the sock 100, the point Q1 corresponding to an instep side end part of the foot (see (a) and (b) of FIG. 17). With the gore line 101, a sock can be knitted so that a first part of the sock which first part surrounds a foot part and a second part of the sock which second part surrounds a lower leg part are substantially at right angles. This allows the sock to fit the shape of a foot and makes it possible to prevent the sock from wrinkling in an anterior part of an ankle joint.

CITATION LIST

Patent Literature

[Patent Literature 1]

Japanese Patent Application Publication, Tokukai, No. 2004-204378 (Publication Date: Jul. 22, 2004)

SUMMARY OF INVENTION

Technical Problem

Note, however, that such a conventional technique as described earlier has the following problem. That is, in a case where a sock is knitted so that a first part thereof surrounding a foot part and a second part thereof surrounding a lower leg part are substantially at right angles, it is necessary to adjust the number of stitches of an instep side end part of a foot.

Generally, a circular knitting machine for knitting a tubular fabric by causing a picker to raise and lower needles is used to manufacture socks. The circular knitting machine knits a heel part or the like of a sock by reciprocating rotary knitting in which a cylinder is in reciprocating motion while some of the needles are out of operation by needle raising so as not to be used for the knitting and the other needles are being used for the knitting. According to the circular knitting machine, in which the picker is used to raise the needles during the reciprocating rotary knitting, a space for the picker is a region in which the reciprocation of the cylinder is restricted. This limits adjustment of a length of the gore line 101, so that the gore line 101 cannot be extended to the point Q1. The circular knitting machine thus has a problem of being incapable of knitting a sock by adjusting the length of the gore line 101 so that a first part of the sock which first part surrounds a foot part and a second part of the sock which second part surrounds a lower leg part are substantially at right angles.

The present invention has been made in view of the problem, and an object of the present invention is to provide a tubular fabric which (i) can be knitted by use of a circular knitting machine including a picker and (ii) is less likely to wrinkle on a bend direction side of a bent part of the tubular fabric which is worn.

Solution to Problem

In order to attain the object, a tubular fabric in accordance with an embodiment of the present invention is a tubular fabric including at least one bent part, the at least one bent part having a bulging part and at least one extended part, the bulging part having: a first bulging region which includes a region in which the number of wales, which is the number of stitches that extend in a circumferential direction of the tubular fabric, decreases from a first end side of the tubular fabric toward a second end side of the tubular fabric; and a second bulging region which is located so as to be closer to the second end side than the first bulging region and which includes a region in which the number of wales increases from the first end side toward the second end side, the first bulging region and the second bulging region each being located so as to be closer to a side opposite from a bend direction side of the tubular fabric than the at least one extended part, the at least one extended part having: a first extended region in which the number of wales increases from the first end side toward the second end side; and a second extended region which is located so as to be continuous with a side of the first extended region which side is closer to the second end side and in which from the first end side toward the second end side, the number of wales decreases from the number of wales on the side of the first extended region which side is closer to the second end side, the at least one extended part being located so as to be closer to the bend direction side than the bulging part, and the at least one extended part having a boundary part between the first extended region and the second extended region which boundary part has a bend direction side first end, and in a case where the tubular fabric is viewed from the bend direction side, the bend direction side first end being located on a center line, with which the tubular fabric is substantially bisected in a direction in which a width of the tubular fabric extends, or within a predetermined distance from the center line.

In order to attain the object, a method, in accordance with an embodiment of the present invention, of knitting a tubular fabric is a method of knitting, by use of a circular knitting machine including a picker, a tubular fabric having at least one bent part, the method including the steps of: a) knitting a first bulging region which includes a region that is knitted by stitch decreasing knitting from a first end side of the tubular fabric toward a second end side of the tubular fabric; b) knitting an extended part by continuously carrying out stitch increasing knitting and stitch decreasing knitting in this order from the first end side toward the second end side; and c) knitting, on a side of the first bulging region which side is closer to the second end side, a second bulging region which includes a region that is knitted by stitch increasing knitting from the first end side toward the second end side, the extended part being located so as to be closer to a bend direction side of the tubular fabric than the first bulging region and the second bulging region, and the extended part having a boundary part between a region that is knitted by the stitch increasing knitting carried out in the step b) and a region that is knitted by the stitch decreasing knitting carried out in the step b), the boundary part having a bend direction side first end, and in a case where the tubular fabric is viewed from the bend direction side, the bend direction side first end being located on a center line, with which the tubular fabric is substantially bisected in a direction in which a width of the tubular fabric extends, or within a predetermined distance from the center line.

Advantageous Effects of Invention

The present invention can provide a tubular fabric which (i) can be knitted by use of a circular knitting machine including a picker and (ii) is less likely to wrinkle on a bend direction side of a bent part of the tubular fabric which is worn.

Figure 1:
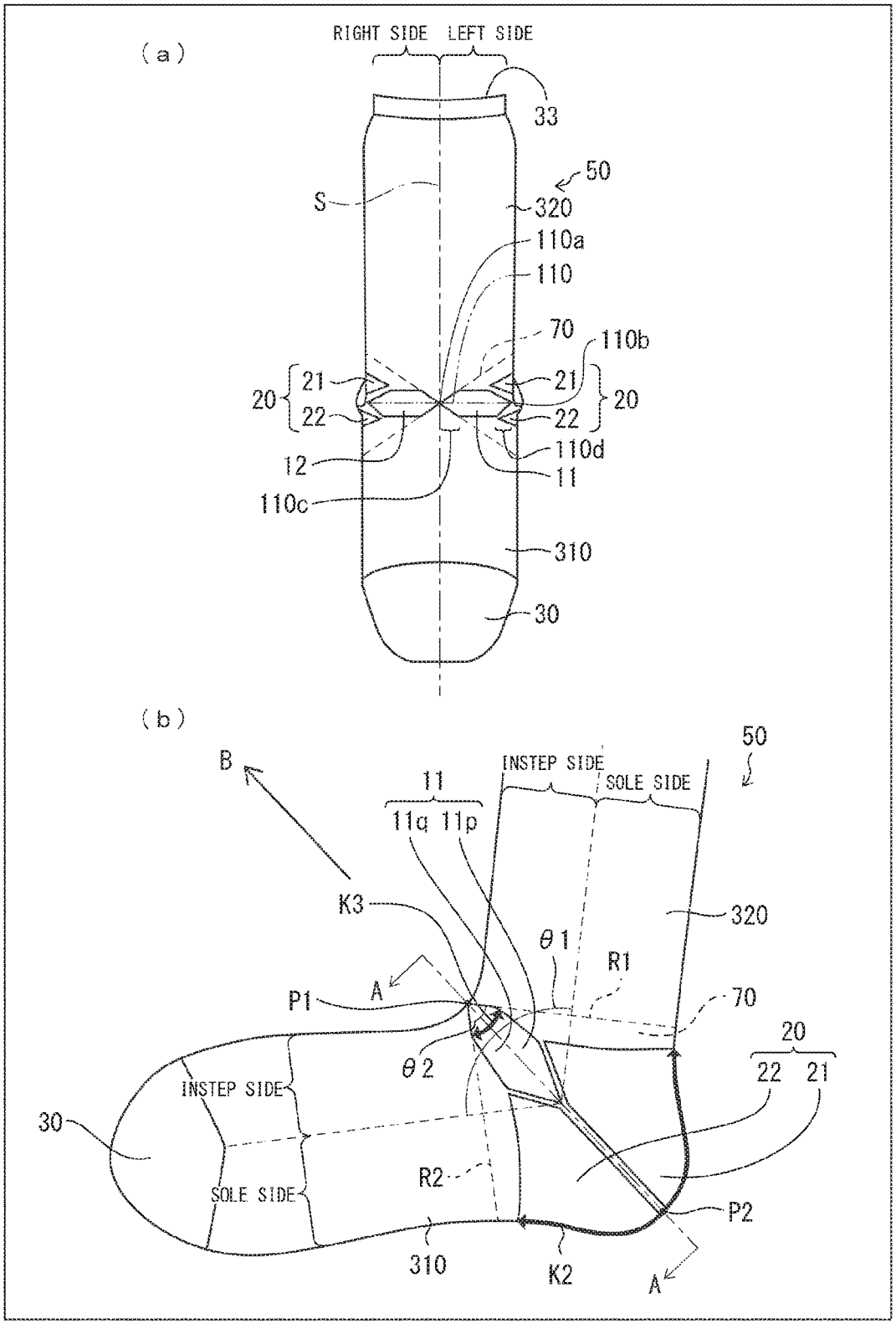

BRIEF DESCRIPTION OF DRAWINGS (a) of FIG. 1 is a view describing a foot dorsum part of a sock in accordance with Embodiment 1 of the present invention. (b) of FIG. 1 is a left side view of the sock.

Figure 2:
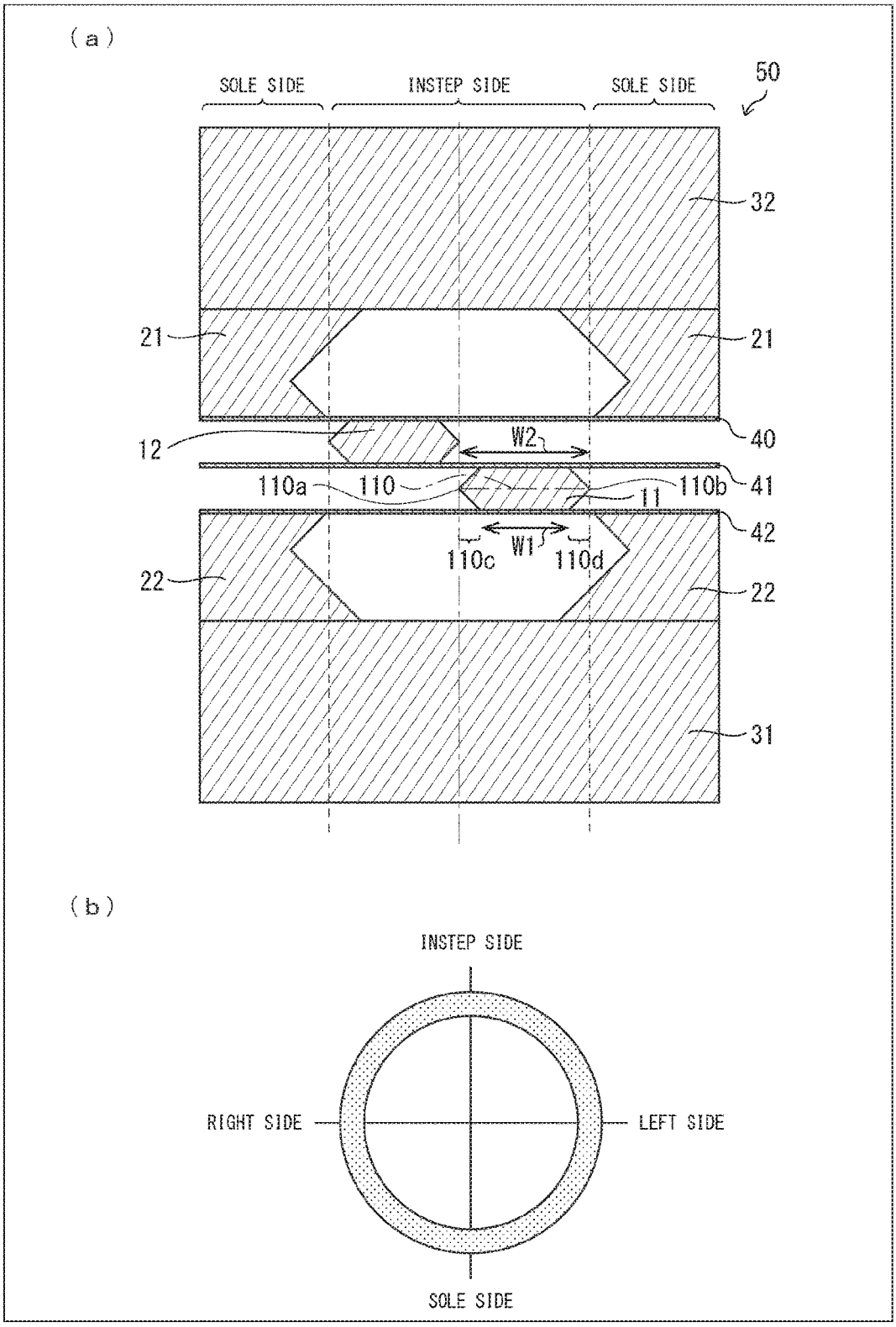

(a) of FIG. 2 is a development of the sock. (b) of FIG. 2 is a cross-sectional view taken from line A-A of (b) of FIG. 1.

Figure 3:
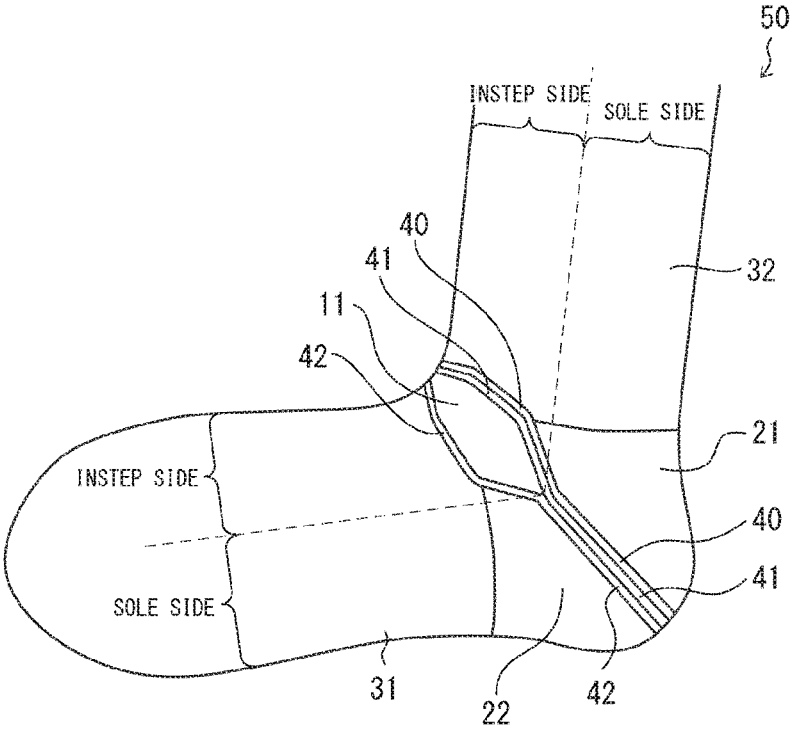

FIG. 3 is a left side view of the sock which left side view describes parts illustrated in the development of (a) of FIG. 2.

Figure 4:
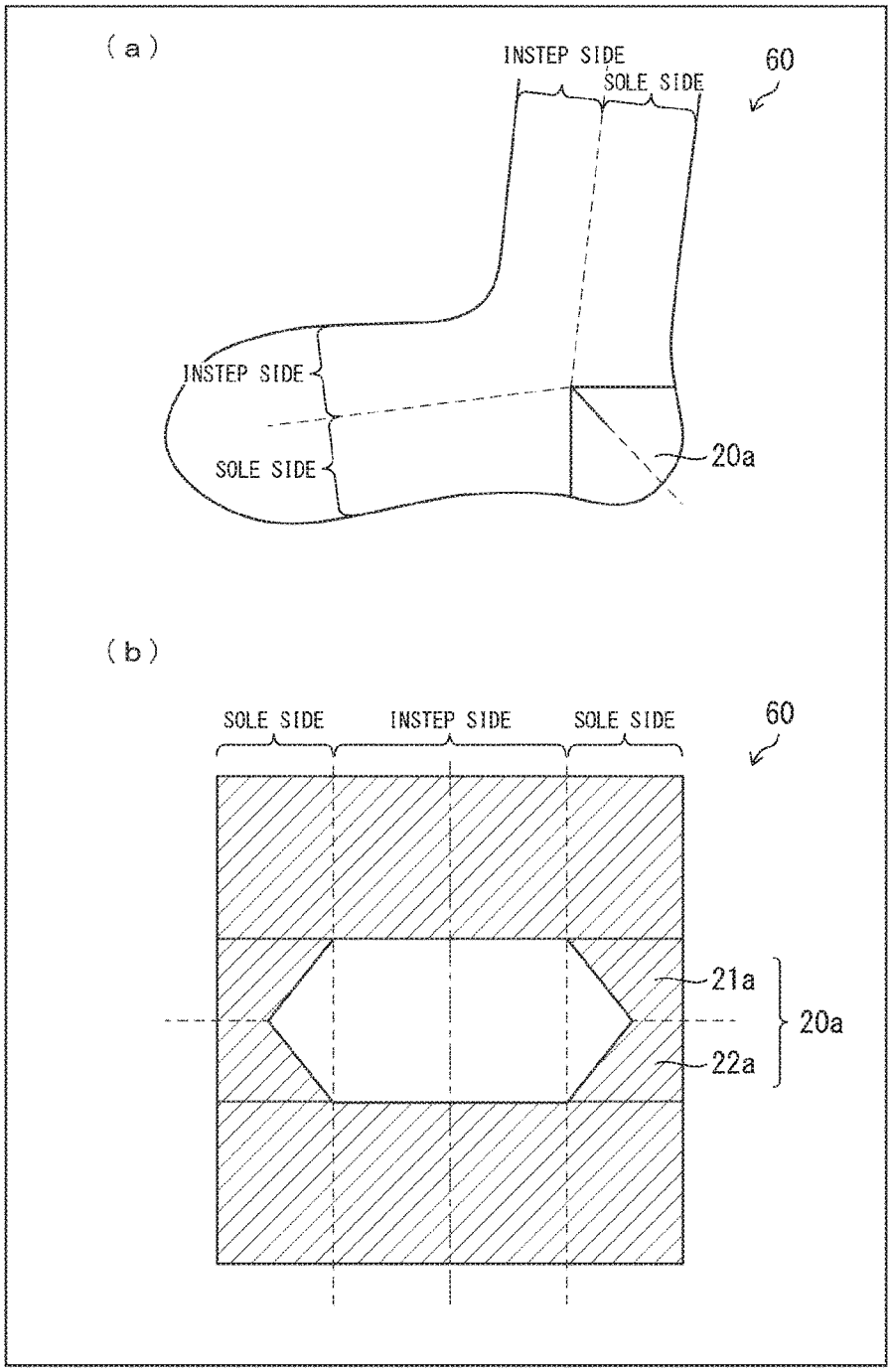

(a) and (b) of FIG. 4 are views illustrating an example of a bulging part.

Figure 5:
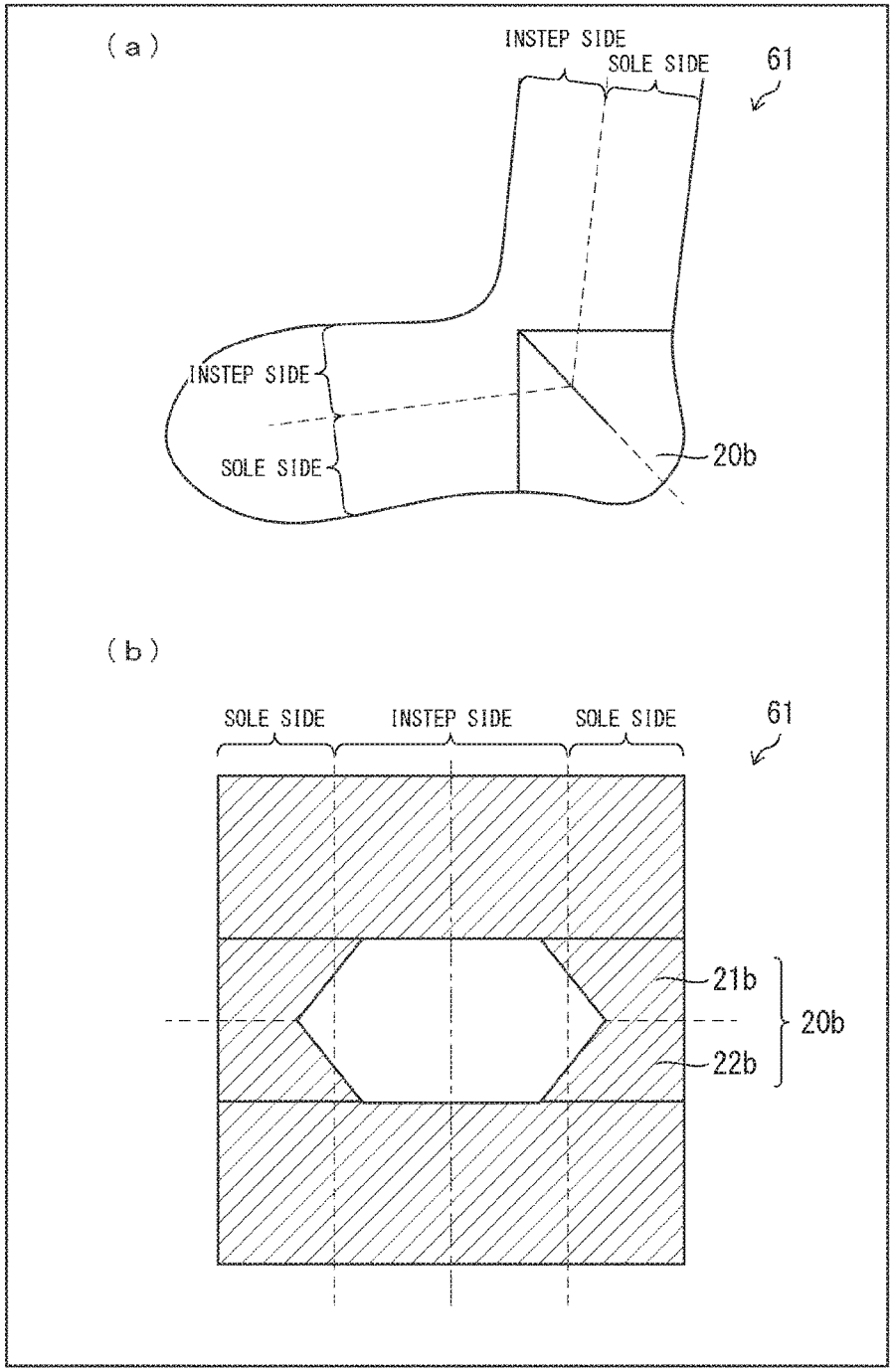

(a) and (b) of FIG. 5 are views illustrating another example of the bulging part.

Figure 6:
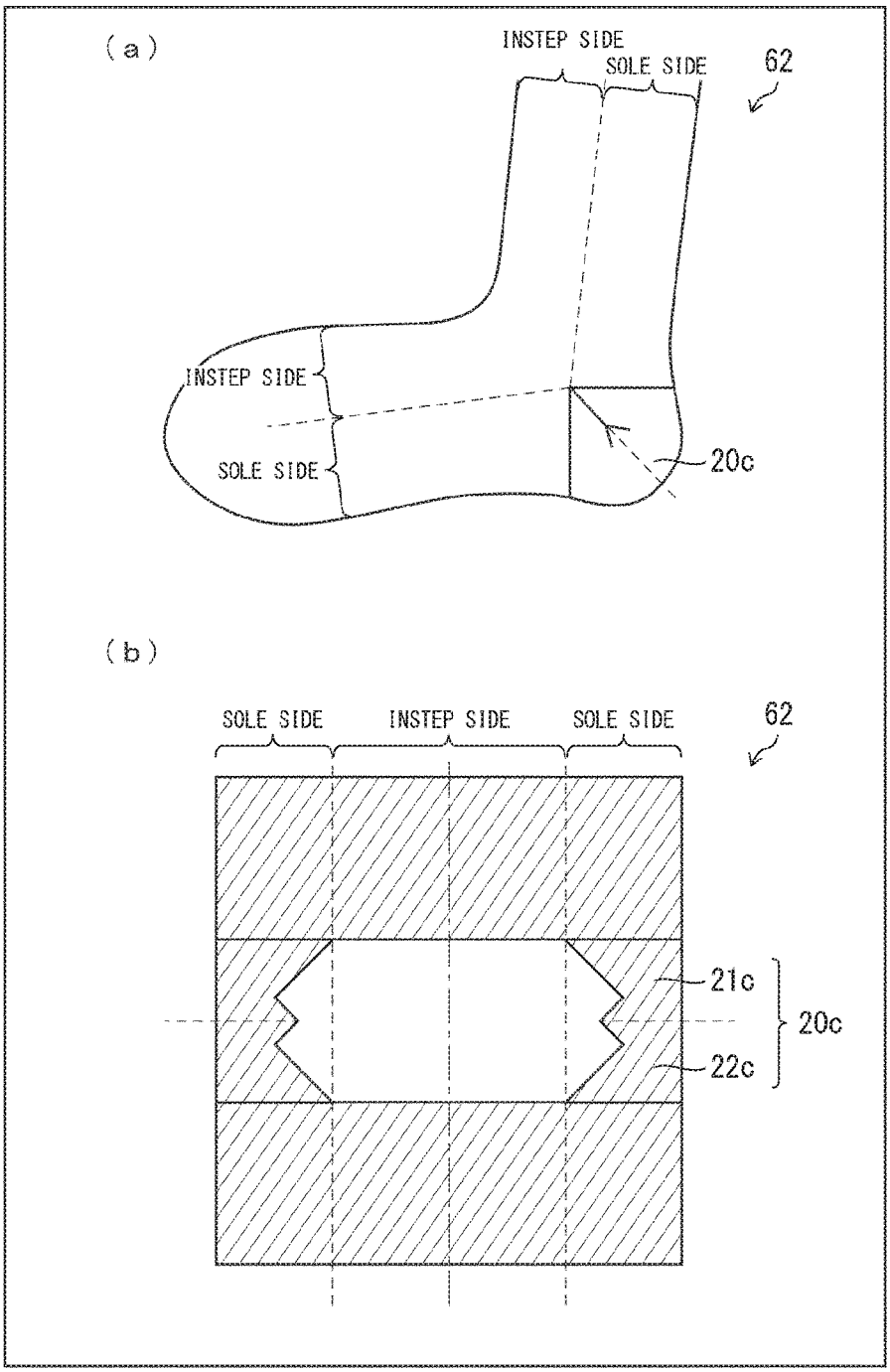

(a) and (b) of FIG. 6 are views illustrating yet another example of the bulging part.

Figure 7:
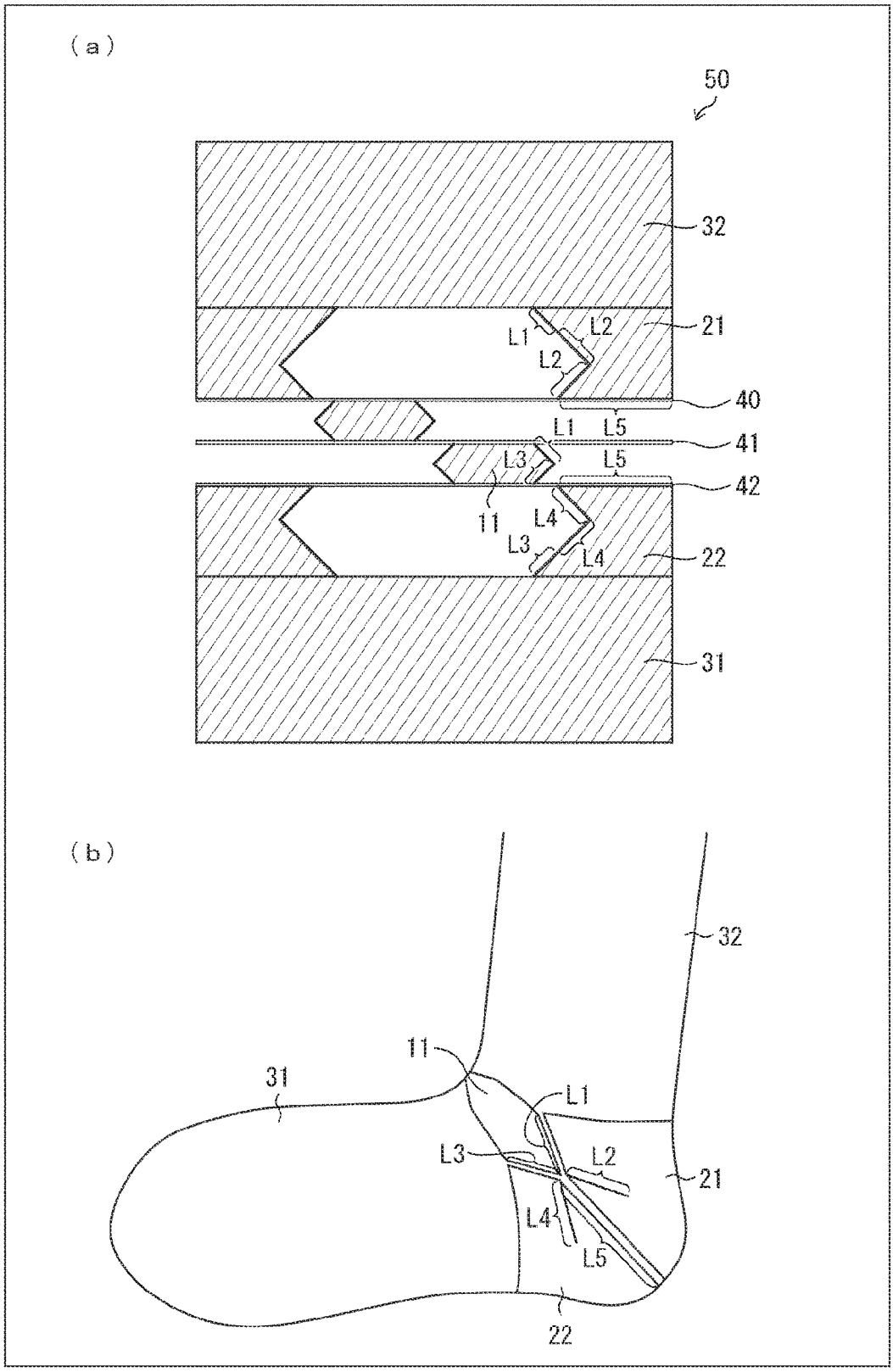

(a) and (b) of FIG. 7 are views illustrating a relationship of adjacency on a left side in the development illustrated in (a) of FIG. 2.

Figure 8:
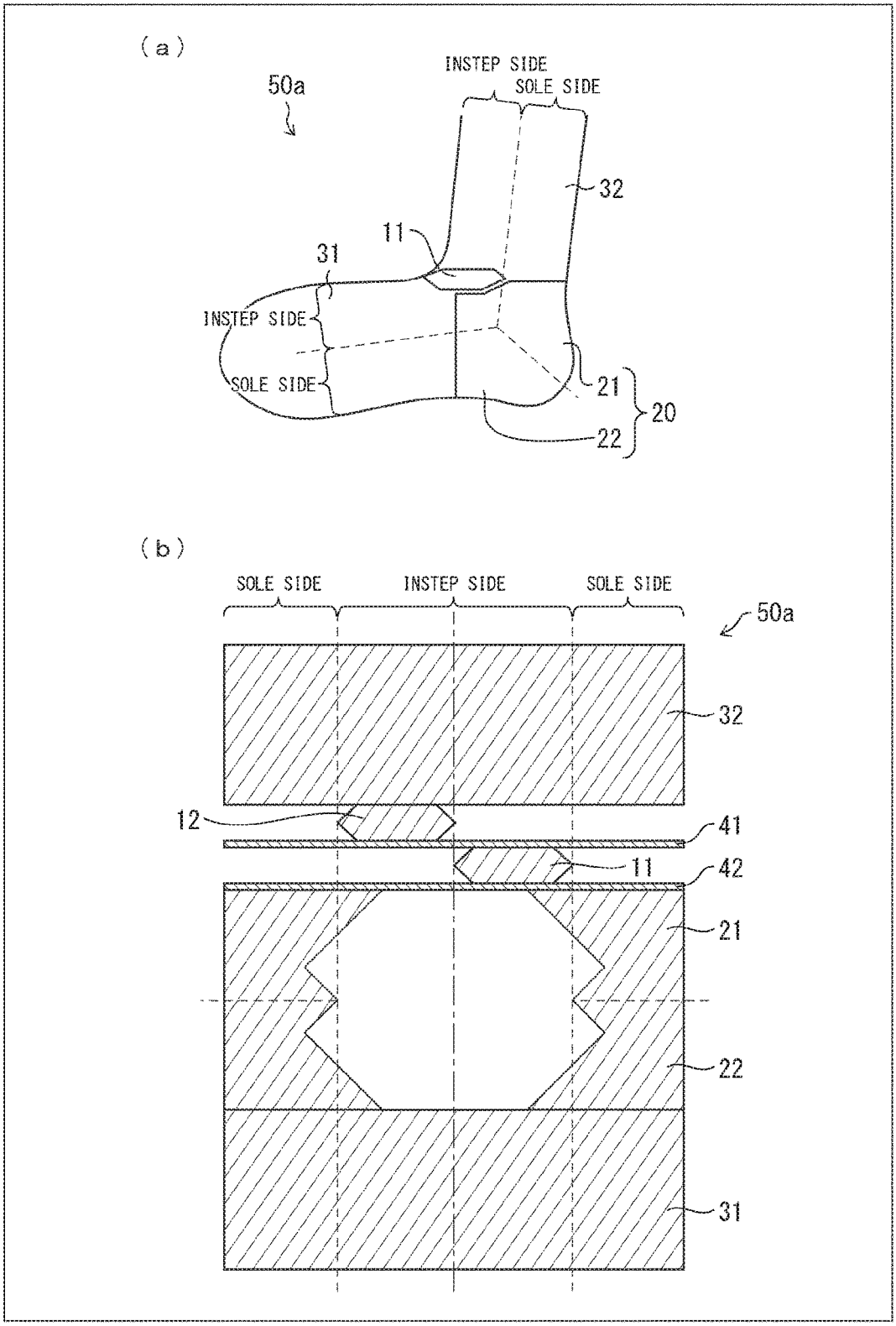

(a) and (b) of FIG. 8 illustrate Variation 1 of the sock.

Figure 9:
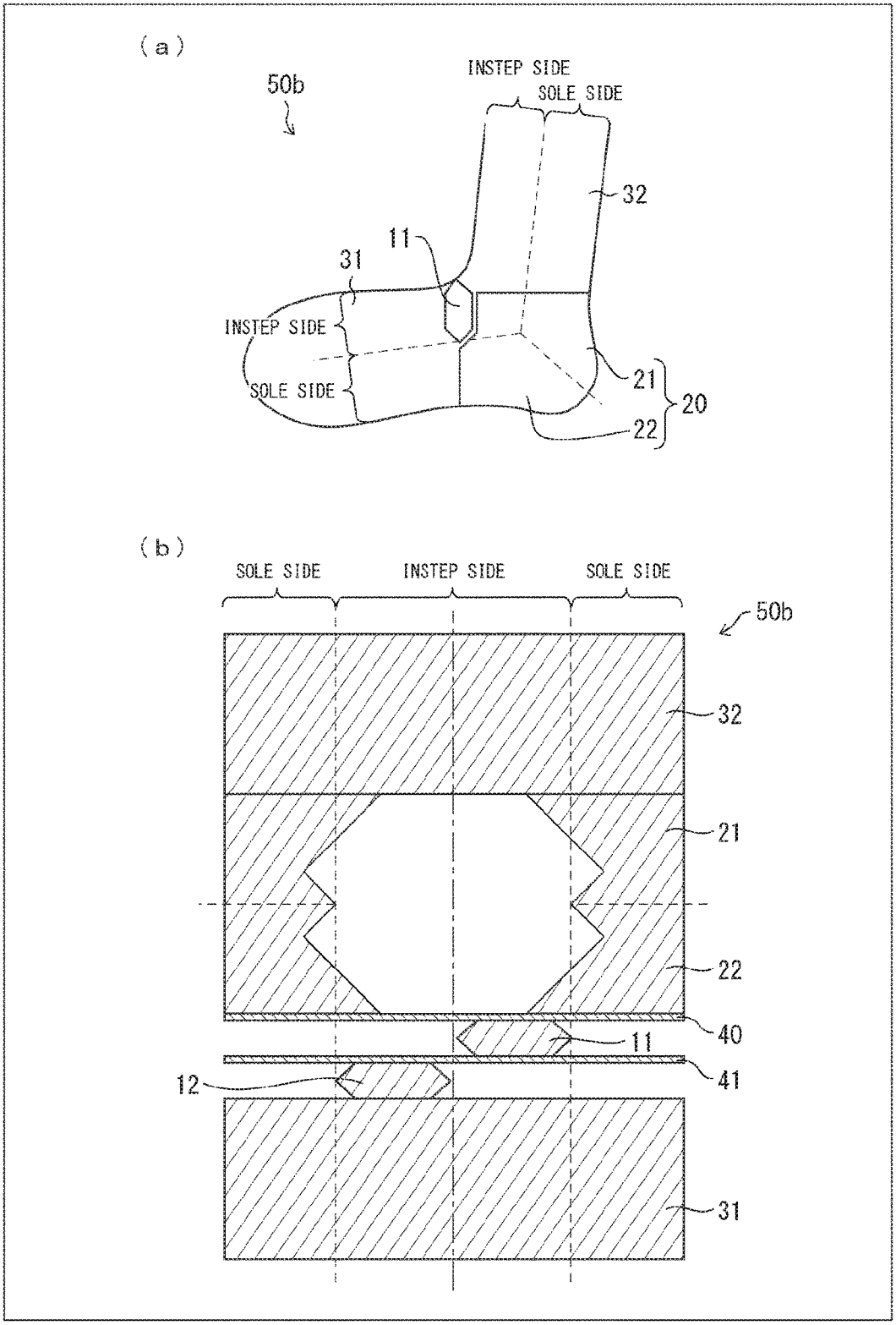

(a) and (b) of FIG. 9 illustrate Variation 2 of the sock.

Figure 10:
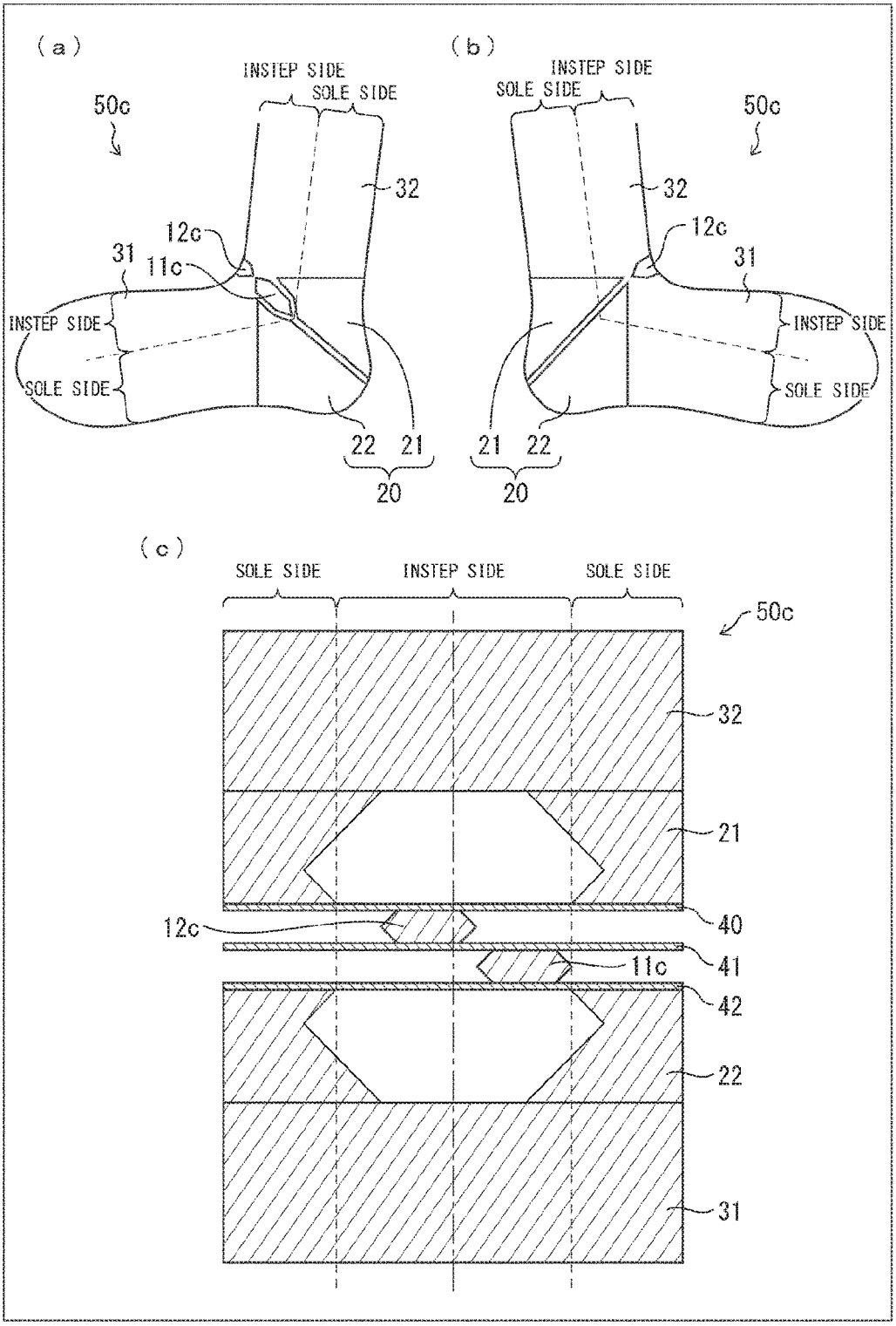

(a) through (c) of FIG. 10 illustrate Variation 3 of the sock.

Figure 11:
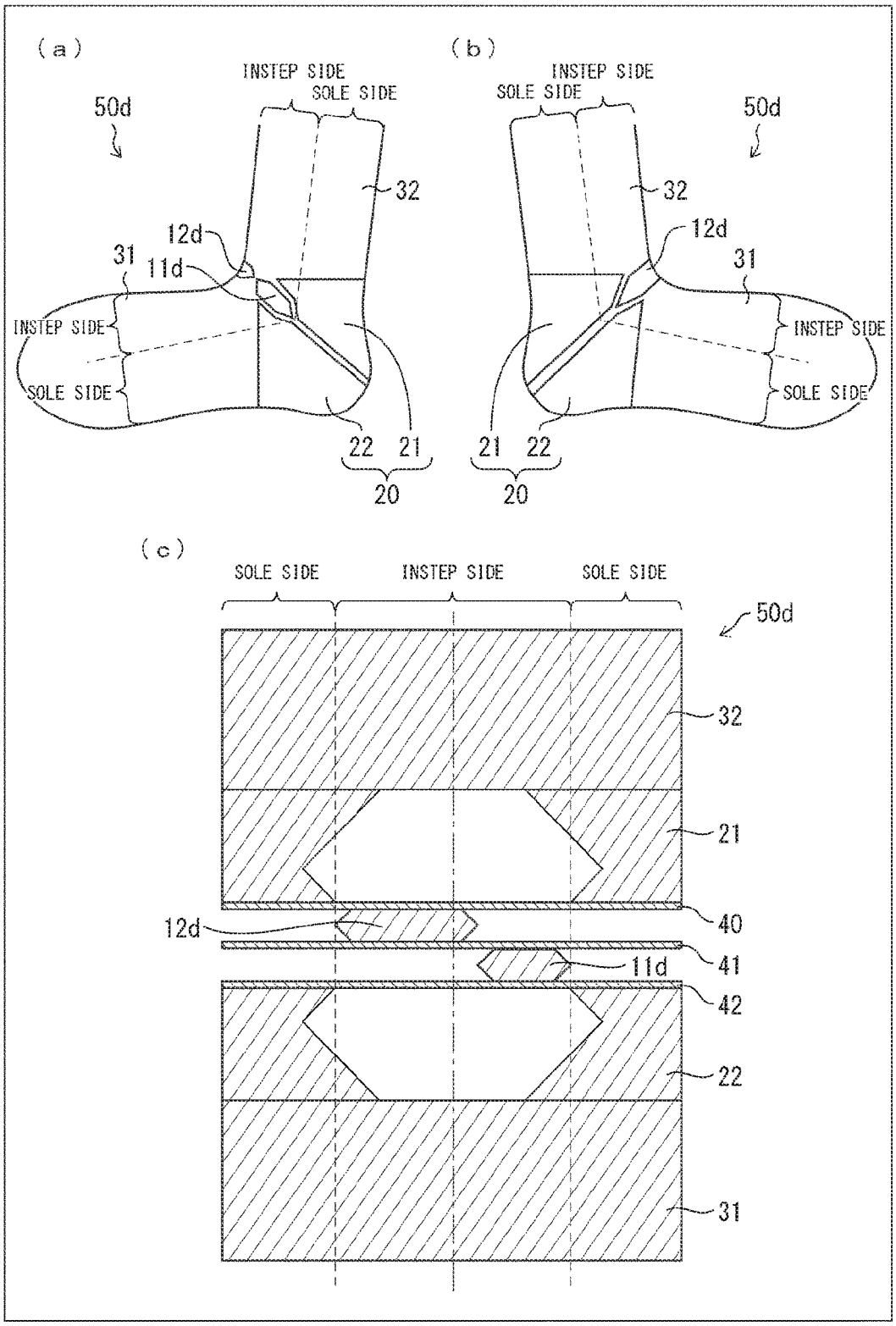

(a) through (c) of FIG. 11 illustrate Variation 4 of the sock.

Figure 12:
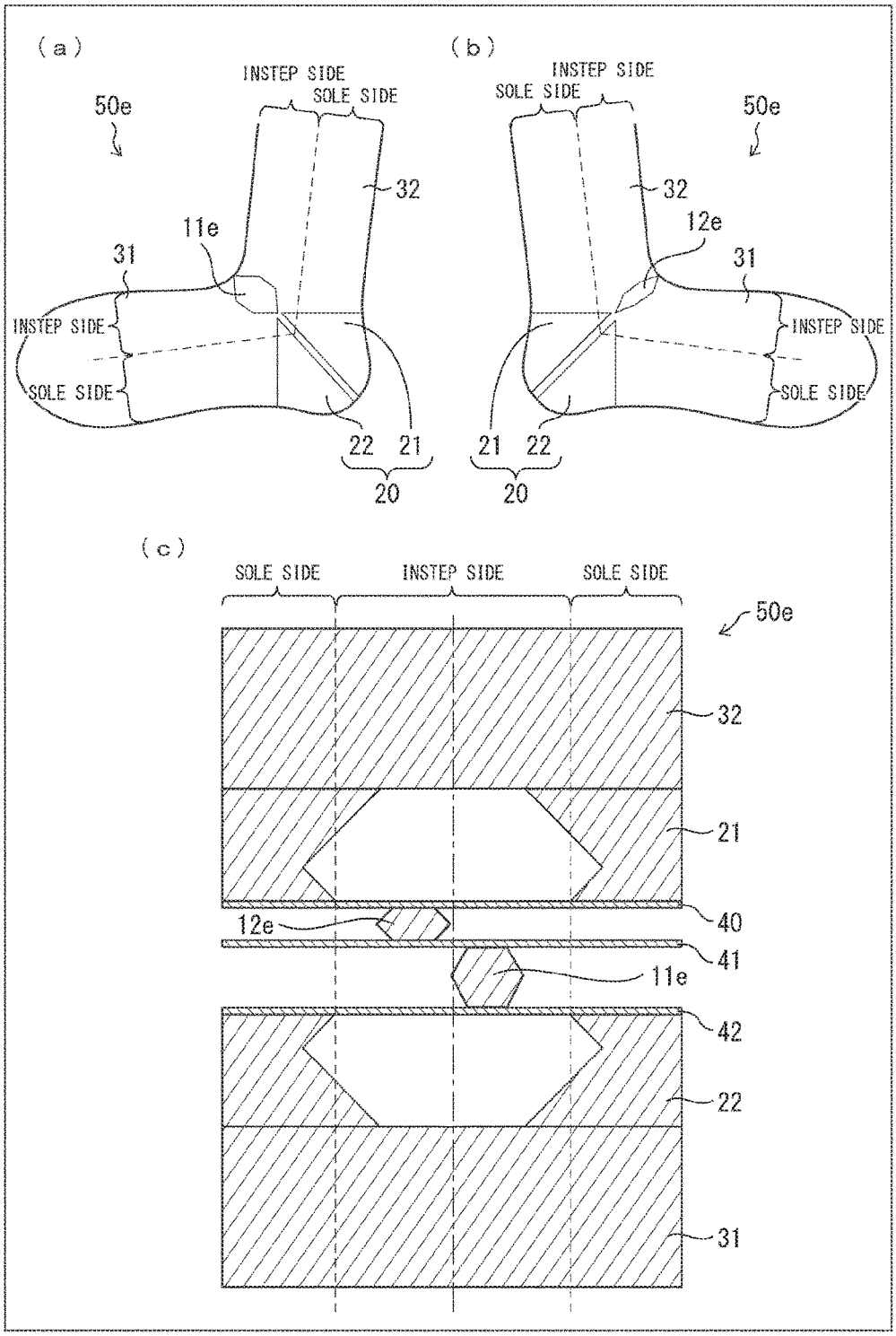

(a) through (c) of FIG. 12 illustrate Variation 5 of the sock.

Figure 13:
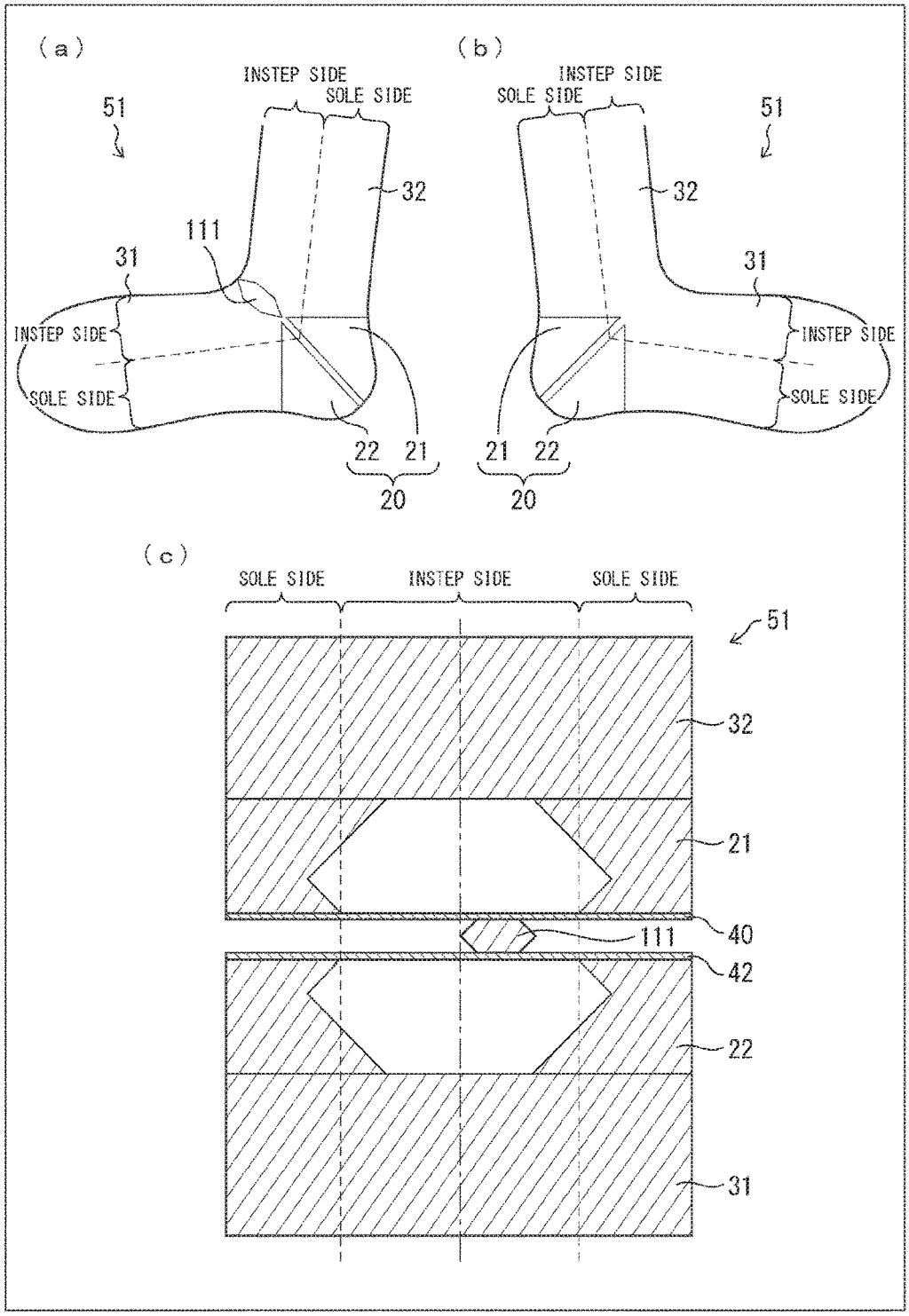

(a) of FIG. 13 is a left side view of a sock in accordance with Embodiment 2 of the present invention. (b) of FIG. 13 is a right side view of the sock. (c) of FIG. 13 is a development of the sock.

Figure 14:
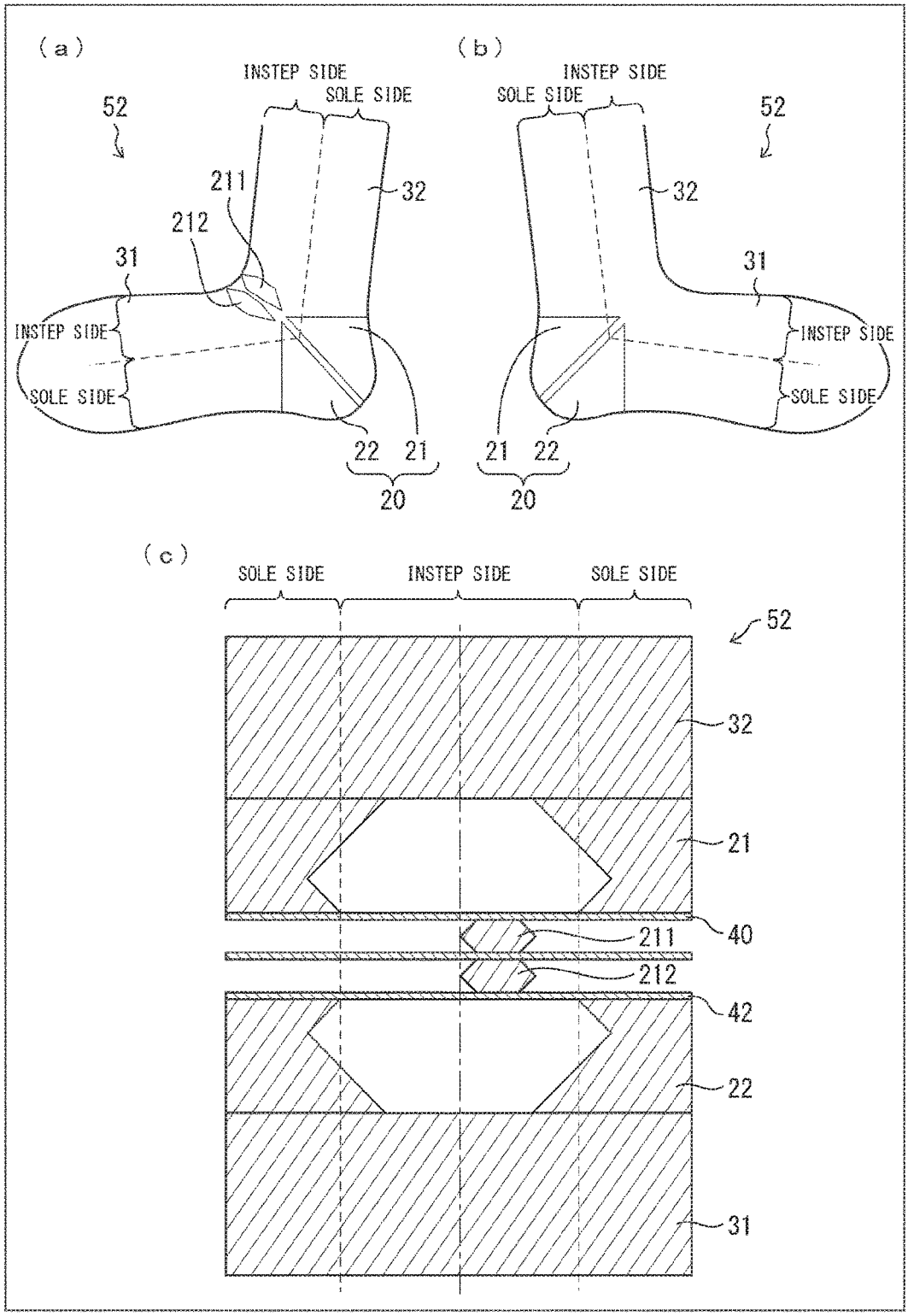

(a) of FIG. 14 is a left side view of a sock in accordance with Embodiment 3 of the present invention. (b) of FIG. 14 is a right side view of the sock. (c) of FIG. 14 is a development of the sock.

Figure 15:
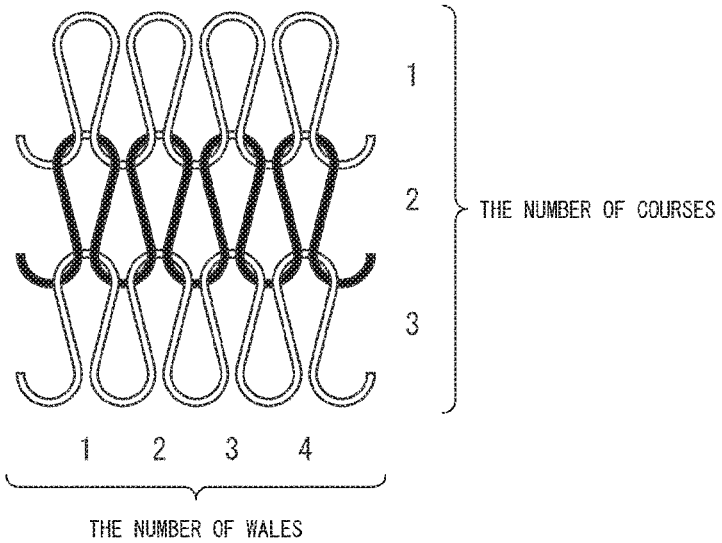

FIG. 15 is a view describing the number of courses and the number of wales.

Figure 16:
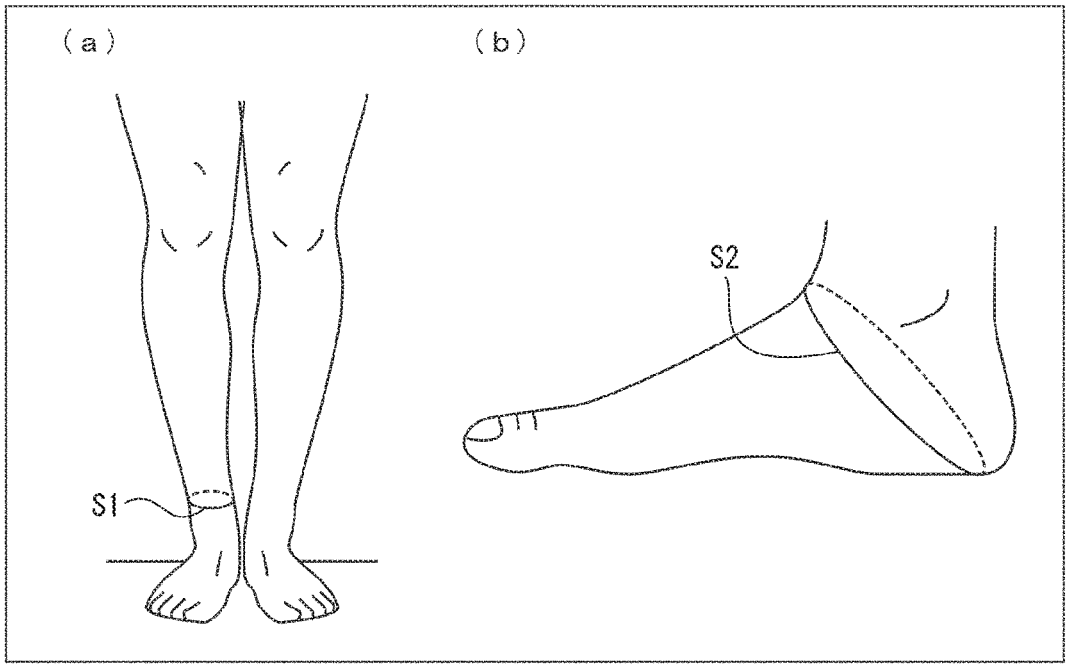

(a) of FIG. 16 is a view illustrating a shortest circumference of a lower leg part. (b) of FIG. 16 is a view illustrating a short heel circumference.

(a) and (b) of FIG. 17 are views illustrating an example of a conventional sock.

DESCRIPTION OF EMBODIMENTS

Embodiment 1

The following description will discuss Embodiment 1 of the present invention with reference to FIGS. 1 through 7. Note that a sock 50 is adaptable to both a right foot and a left foot.

(Arrangement of Sock 50)

(a) of FIG. 1 is a view describing a foot dorsum part of the sock 50 in accordance with Embodiment 1 of the present invention. (b) of FIG. 1 is a left side view of the sock 50. In other words, (a) of FIG. 1 is a view of the sock 50 which is viewed in a bend direction in which the sock 50 is bent. (a) of FIG. 2 is a development of the sock 50. (b) of FIG. 2 is a cross-sectional view taken from line A-A of (b) of FIG. 1. FIG. 3 is a left side view of the sock 50 which left side view describes parts illustrated in the development of (a) of FIG. 2. Note that an arrow B of (b) of FIG. 1 indicates the bend direction in which the sock 50 is bent. The bend direction is substantially parallel to a line connecting a valley fold part P1 and a mountain fold part P2, each of which will be described later.

The following description discusses, with reference to FIG. 15, the number of wales, which is used in description of each of embodiments, and the number of courses, which is used in description of each of the embodiments. FIG. 15 is a view describing the number of courses and the number of wales. As illustrated in FIG. 15, the number of wales indicates the number of stitches that are continuous in a circumferential direction of the sock 50, i.e., the number of stitches that extend in the circumferential direction of the sock 50. The number of wales of a fabric illustrated in FIG. 15 is four. The number of courses is the number of stitches that are continuous in a longer side direction of the sock 50, i.e., the number of stitches that extend in a direction from a first end of the sock 50 to a second end of the sock 50. The number of courses of the fabric illustrated in FIG. 15 is three.

The sock 50 (tubular fabric) is a tubular fabric knitted by a circular knitting machine (hereinafter referred to as a "common circular knitting machine"), including a picker, for causing the picker to raise and lower needles. The sock 50 has a bent part 70 which is plain knitted. Fabric that is plain knitted has no large unevenness thereon and thus has a smaller thickness. Such plain knitting can prevent fabric from wrinkling due to a thickness of the fabric and unevenness of the fabric.

The sock 50 has a toe part 30, a tubular foot part 310, a tubular leg part 320, and the bent part 70 (see (a) and (b) of FIG. 1). The toe part 30, the tubular foot part 310, the bent part 70, and the tubular leg part 320 are integrally knitted in this order.

The toe part 30 covers a toe of a leg put in the sock 50. The toe part 30 is knitted so as to be adjacent to the tubular foot part 310. The toe part 30 has an end part knitted in the shape of a bag. The toe part 30 can be knitted by, for example, in (a) of FIG. 2, sewing up an end part of a foot part 31 which end part is on a side opposite from a leg part 32. Note that the sock 50 does not need to have the toe part 30. For simplification of description, the toe part 30 is not illustrated in FIGS. 2 through FIG. 14.

The tubular foot part 310 covers a foot part different from the toe of and a malleolus part of the leg put in the sock 50. The tubular foot part 310 is knitted so as to have (i) a first end that is adjacent to the toe part 30 and (ii) a second end that is adjacent to the bent part 70. The tubular foot part 310 is a long and thin, and hollow tubular fabric.

The tubular leg part 320 covers a lower leg part of the leg put in the sock 50. The tubular leg part 320 is knitted so as to have (i) at least a first end that is provided with an opening 33 and (ii) a second end that is adjacent to the bent part 70. A user can put a leg thereof in the sock 50 through the opening 33. The tubular leg part 320 is a long and thin, and hollow tubular fabric.

(Bent Part)

The bent part 70 is described below. The following description assumes that the left and the right when the sock 50 is viewed from a foot dorsum part side are a "right side" and a "left side", respectively (see (a) and (b) of FIG. 1, and (a) and (b) of FIG. 2). The following description also assumes that a foot dorsum part side and a sole side when the sock 50 is viewed from a side of the sock 50 are an "instep side (a valley fold part side, a bend direction side)" and a "sole side (a mountain fold part side, a side opposite from the bend direction side)", respectively.

The bent part 70 is located between the tubular foot part 310 and the tubular leg part 320, and covers a part extending from an ankle to a heel (see (b) of FIG. 1).

The bent part 70 is a range defined by a line R1 and a line R2 which are described below. The line R1 is (1) a line obtained by extending, from a bend direction side first end 110*a* of a boundary part of an extended part 11 (described later), a first course on which stitches of an end part of the extended part 11 which end part contacts the tubular leg part 320 are arranged and (2) a line obtained by extending, from the bend direction side first end 110*a* of a boundary part of an extended part 12, the first course on which stitches of an end part of the extended part 12 which end part contacts the tubular leg part 320 are arranged. The line R2 is (1) a line obtained by extending, from the bend direction side first end 110*a* of the boundary part of the extended part 11, a second course on which stitches of an end part of the extended part 11 which end part contacts the tubular foot part 310 are arranged and (2) a line obtained by extending, from the bend direction side first end 110*a* of the boundary part of the extended part 12, the second course on which stitches of an end part of the extended part 12 which end part contacts the tubular foot part 310 are arranged.

The bent part 70 allows the tubular foot part 310 to be bent in the bend direction from the tubular leg part 320, so that the tubular foot part 310 and the tubular leg part 320 form a bend angle θ1 therebetween. The sock 50 is desirably arranged such that the bent part 70 has the bend angle θ1 which is 90°. When the sock 50 is viewed from a left side, the bent part 70 is substantially in the shape of a fan whose center is an extended part 12 side vertex of the extended part 11.

The bent part 70 has the extended parts 11 and 12, and a bulging part 20.

(Bulging Part)

The bulging part 20 has (1) a first bulging region 21 which includes a region in which the number of wales, which is the number of stitches that extend in the circumferential direction of the sock 50, decreases from a first end side of the sock 50 toward a second end side of the sock 50 and (2) a second bulging region 22 which is located so as to be closer to the second end side than the first bulging region 21 and which includes a region in which the number of wales increases from the first end side toward the second end side.

The bulging part 20 covers a heel. The first bulging region 21 and the second bulging region 22 are located so as to be closer to the side opposite from the bend direction side than the extended parts 11 and 12.

According to the sock 50, the tubular foot part 310 and the tubular leg part 320 are knitted in a tubular shape by circumferential knitting by use of a circular knitting machine, and the bent part 70 is knitted by the circumferential knitting and reciprocating rotary knitting by use of the circular knitting machine.

According to the reciprocating rotary knitting, a fabric is knitted in, for example, a state in which a cylinder of the circular knitting machine is in reciprocating motion while some of needles that are used to knit the tubular leg part 320 of the sock 50 are being raised by use of a picker so as not to be used to knit the bent part 70 and the other needles are being used to knit the bent part 70.

The bulging part 20 is knitted with the number of stitches decreased (hereinafter, such knitting is referred to as "stitch decreasing knitting"), and knitted with the number of stitches increased (hereinafter, such knitting is referred to as "stitch increasing knitting").

Stitch decreasing knitting is knitting such that during half rotation knitting, a trapezoidal fabric is knitted whose knitting width is gradually decreased by decreasing, by two, the number of needles, used for knitting, of the cylinder for each stroke of half rotation knitting.

Stitch increasing knitting is knitting such that during half rotation knitting, a trapezoidal fabric is knitted whose knitting width is increased by, in contrast to the case of stitch decreasing knitting, increasing, by two, the number of needles, located at an end part of a region in which the cylinder is in reciprocating motion.

(Types of Bulging Part)

The bulging part 20 is classified into three types, which are a normal heel type, a large heel type, and a Y-shaped heel type, in accordance with how the bulging part 20 is knitted. These types are adaptable to the sock 50 in accordance with for what the bulging part 20 is to be used. The following description will discuss the type of bulging part 20 with reference to FIGS. 4 through 6. (a) and (b) of FIG. 4 are views illustrating an example of the bulging part 20. Specifically, (a) of FIG. 4 is a left side view of a sock 60 having a bulging part 20*a* of the normal heel type, and (b) of FIG. 4 is a development of the sock 60 having the bulging part 20*a*. (a) and (b) of FIG. 5 are views illustrating another example of the bulging part 20. Specifically, (a) of FIG. 5 is a left side view of a sock 61 having a bulging part 20*b* of the large heel type, and (b) of FIG. 5 is a development of the sock 61 having the bulging part 20*b*. (a) and (b) of FIG. 6 are views illustrating yet another example of the bulging part 20. Specifically, (a) of FIG. 6 is a left side view of a sock 62 having a bulging part 20*c* of the Y-shaped heel type, and (b) of FIG. 6 is a development of the sock 62 having the bulging part 20*c*.

(Normal Heel)

As illustrated in (a) and (b) of FIG. 4, the bulging part 20*a* has a bend direction side end part that is located on the sole side or at a boundary between the sole side and the instep side. According to the bulging part 20*a*, a first bulging region 21*a* is knitted by stitch decreasing knitting, and then a second bulging region 22*a* is knitted by stitch increasing knitting. Use of the bulging part 20*a* allows fabric on the sole side to have a larger area than fabric on the instep side. This allows a decrease in wrinkle on the valley fold part side of the sock 60 which is worn.

(Large Heel)

As illustrated in (a) and (b) of FIG. 5, the bulging part 20*b* has a bend direction side end part that is located on the instep side. Thus, the bulging part 20*b* has a larger area of fabric on the sole side than the bulging part 20*a*. Consequently, the sock 61 has a larger ratio of the area of the fabric on the sole side to an area of fabric on the instep side than the sock 60. This allows a further decrease in wrinkle on the valley fold part side of the sock 61 which is worn.

According to the bulging part 20*b*, a first bulging region 21*b* is knitted by stitch decreasing knitting, and then a second bulging region 22*b* is knitted by stitch increasing knitting. The bulging part 20*b* is knitted by reciprocating rotary knitting in which a cylinder rotates at an angle of not less than 180°.

(Y-Shaped Heel)

As illustrated in (a) and (b) of FIG. 6, the bulging part 20*c* has a first bulging region 21*c* and a second bulging region 22*c*.

The first bulging region 21*c* includes (1) a first region in which the number of wales decreases from a first end of the sock 62 toward a second end of the sock 62 and (2) a second region which is located between the first region and the second bulging region 22*c* and in which the number of wales increases from the first end toward the second end. In other words, the first bulging region 21*c* is knitted by carrying out stitch decreasing knitting and then carrying out stitch increasing knitting.

The second bulging region 22*c* includes (1) a first region in which the number of wales increases from the first end of the sock 62 toward the second end of the sock 62 and (2) a second region which is located between the first region of the second bulging region 22*c* and the first bulging region 21*c* and in which the number of wales decreases from the first end toward the second end. In other words, the second bulging region 22*c* is knitted by carrying out stitch decreasing knitting and then carrying out stitch increasing knitting.

The number of wales which is obtained at the start of knitting of the first bulging region 21*c* is larger than that obtained at the end of knitting of the first bulging region 21*c* (the first bulging region 21*c* has a larger number of wales on the opening 33 side than on the toe part 30 side). The number of wales which is obtained at the end of knitting the second bulging region 22*c* is larger than that obtained at the start of knitting of the second bulging region 22*c* (the second bulging region 22*c* has a larger number of wales on the toe part 30 side than on the opening 33 side). The bulging part 20*c* has a larger area of fabric on a sole side than the bulging part 20*a*. Thus, the sock 62 has a larger ratio of the area of the fabric on the sole side to an area of fabric on an instep side than the sock 60. This allows a further decrease in wrinkle on the valley fold part side of the sock 62 which is worn.

The bulging part 20 (illustrated in (b) of FIG. 1) of Embodiment 1 is obtained by combining the large heel type and the Y-shaped heel type. Specifically, the bulging part 20 is knitted on the sole side so as to extend across right and left sides of the bent part 70, and the bulging part 20 has a bend direction side end part that is located on the instep side. Further, by reciprocating rotary knitting, the first bulging region 21 is knitted by carrying out stitch decreasing knitting and then carrying out stitch increasing knitting, and thereafter the second bulging region 22 is further knitted by carrying out stitch decreasing knitting and then carrying out stitch increasing knitting. Stitch decreasing knitting and stitch increasing knitting can be continuously carried out or can be discontinuously carried out.

(Design of Bulging Part)

The following description will discuss, with reference to (a) and (b) of FIG. 7, how to set the optimal number of stitches in a case where a sock is knitted by use of a common circular knitting machine including 144 needles. The number of needles of a circular knitting machine is equal to the number of wales of a circumference of a tubular fabric. Note that lines L1 through L4 illustrated in (a) and (b) of FIG. 7 are gore lines.

The number of wales of the gore lines illustrated in (a) and (b) of FIG. 7 (the number of wales of a total of (i) the line L1 and the line L2 or (ii) the line L3 and the line L4) is desirably approximately 15% to 20% of the number of the needles of the circular knitting machine. Specifically, in a case where the number of needles is 144, the number of wales of the gore lines is desirably 25.

A gore line which has a too large number of wales causes the bulging part to cover a too large area of the heel, so that the sock does not fit the heel. In contrast, a gore line which has a too small number of wales causes the bulging part to cover a too small area of the heel, so that the sock does not fit the heel. Note that in a case where the bulging part is of a common large heel type (in which no extended parts 11 and 12 are knitted), the number of wales of a gore line of the bulging part 20 on the right or left side of the sock is approximately 18% of the number of the needles of the circular knitting machine. Specifically, in a case where the number of needles is 144, the number of wales of a gore line of the sock 61 whose bulging part is of the common large heel type is approximately 25.

(Extended Part)

As illustrated in (a) and (b) of FIG. 1, the extended part 11 (extended part) has (1) a first extended region 11*p* in which the number of wales increases from the first end side of the sock 50 (the opening 33 side) toward the second end side of the sock 50 (the toe part 30 side) and (2) a second extended region 11*q* which is located so as to be continuous with a side of the first extended region 11*p* which side is closer to the second end side and in which from the first end side toward the second end side, the number of wales decreases from the number of wales on the side of the first extended region 11*p* which side is closer to the second end side. The extended part 11 is located so as to be closer to the bend direction side than the bulging part 20.

The extended part 11 has the boundary part 110 between the first extended region 11*p* and the second extended region 11*q* which boundary part 110 has the bend direction side first end 110*a*, and in a case where the sock 50 is viewed from the bend direction side, the bend direction side first end 110*a* is located on a center line S, with which the sock 50 is substantially bisected in a direction in which a width of the sock 50 extends, or within a predetermined distance from the center line S. Note here that "on the center line S or within the predetermined distance from the center line S" means a range in which the number of wales from the center line S is not less than zero and not more than 17% of the number of wales of a circumference of the sock 50. Specifically, in the case of a circular knitting machine including 144 needles, "on the center line S or within the predetermined distance from the center line S" means that the first end 110*a* is located in a range in which the number of wales from the center line S is 0 to 24. A location at which the number of wales from the center line S is zero means that the first end 110*a* is located on the center line S. The first end 110*a* which is located so as to be closer to the center line S in the above range makes it possible to knit the sock 50 whose right and left sides are better balanced and which has a better appearance. In contrast, the first end 110*a* which is located so as to be farther from the center line S in the above range makes it possible to knit the sock 50 in which a bulging portion of an ankle joint part and a bend direction side vertex (the first end 110*a*) coincide with each other and which fits the shape of a foot.

The first extended region 11*p* is knitted by stitch increasing knitting, whereas the second extended region 11*q* is knitted by stitch decreasing knitting. That is, the boundary part 110 is a part in which stitch increasing knitting and stitch decreasing knitting are switched from each other.

The extended part 11 and the extended part 12 are knitted so as to be adjacent to each other in the circumferential direction of the sock 50. Specifically, the extended part 11 and the extended part 12 are knitted so as to be adjacent to each other on the circumference of the sock 50 which circumference passes through (i) a point of transition from the right side to the left side at a boundary between a rear surface of an ankle part of the sock 50 and a sole surface of the sock 50, i.e., a boundary between the first bulging region 21 and the second bulging region 22, (the mountain fold part P2 in (b) of FIG. 1) and (ii) a boundary between a front surface of a lower leg part of the sock 50 and the foot dorsum part of the sock 50 (the valley fold part P1 in (b) of FIG. 1). That is, the extended part 11 and the extended part 12 are adjacent to each other across the center line S.

The extended part 11 is located on the left instep side, and the extended part 12 is located on the right instep side. The extended part 11 and the extended part 12 are knitted so as to be adjacent to each other via a circumferentially knitted part 41 (see (a) of FIG. 2).

The extended parts 11 and 12 are located so as to be substantially symmetrical with respect to the valley fold part P1 on the circumference. The bulging part 20 is located so as to be substantially symmetrical with respect to the valley fold part P1 on the circumference.

The extended part 11 and the extended part 12 are desirably knitted on courses that are in proximity to each other. Note here that "courses that are in proximity to each other" mean, for example, courses that are adjacent to each other, or courses that are separated from each other as much as a course(s) of the circumferentially knitted part 40.

The extended part 11 is substantially hexagonal. The first extended region 11*p* is knitted first by stitch increasing knitting, and then the second extended region 11*q* is knitted by stitch decreasing knitting.

The first extended region 11*p* and the second extended region 11*q* are desirably equal in maximum number of courses. In addition, the first extended region 11*p* and the second extended region 11*q* are desirably equal in number of wales. With the arrangement, it is possible to knit the sock 50 in which (i) the leg part 32 (see FIG. 3, corresponding to the tubular leg part 320) which is continuous with the first extended region 11*p* and (ii) the foot part 31 (see FIG. 3, corresponding to the tubular foot part 310) which is continuous with the second extended region 11*q* are bent symmetrically with respect to the boundary part 110 between the first extended region 11*p* and the second extended region 11*q*. The sock 50 in which the leg part 32 and the foot part 31 are bent symmetrically with respect to the boundary part 110 has an appearance that is excellent in balance.

A sole side end part of the extended part 11 (a second end 110*b* of the boundary part 110) is provided between the first bulging region 21 and the second bulging region 22 (see (b) of FIG. 1).

A first end part 110*c* (see (a) of FIG. 1) including the first end 110*a* of the boundary part 110 is shaped to be tapered from the second end 110*b* of the boundary part 110 toward the first end 110*a* of the boundary part 110. A second end part 110*d* (see (a) of FIG. 1) including the second end 110*b* of the boundary part 110 is shaped to be tapered from the first end 110*a* of the boundary part 110 toward the second end 110*b* of the boundary part 110. The first end part 110*c* of the boundary part 110 is an instep side end part of the boundary part 110, and the second end part 110*d* is a sole side end part of the boundary part 110. Due to respective shapes of the first end part 110*c*, the second end part 110*d*, and the bulging part 20, each of the extended parts 11 and 12 has a relatively smaller area on the bend direction side than on the side opposite from the bend direction side. Thus, the sock 50 does not become loose on the valley fold part side, so that the sock 50 which is worn can less wrinkle on the valley fold part side.

The first end part 110*c* is desirably arranged such that the first end 110*a* of the boundary part 110 has a central angle θ2 of approximately 90°, the central angle θ2 being formed between two sides connected at the first end 110*a* of the boundary part 110. Note here that "approximately 90°" means a range which can be deemed to be substantially 90°, e.g., a range from 90° to 120°. This makes it possible to knit the sock 50 (i) whose bent part is bent at 90°, (ii) which fits the shape of a foot, and (iii) which is less likely to wrinkle on the bend direction side of the bent part while being worn.

The extended part 12 is knitted as in the case of the extended part 11. According to Embodiment 1, the extended parts 11 and 12 are identical in shape, and the extended parts 11 and 12 are also equal in number of wales and number of courses. That is, the extended part 11 and the extended part 12 are equal in maximum number of wales and maximum number of courses. This allows the extended parts 11 and 12 on the respective left and right sides to be equal in area. This makes it possible to knit the sock 50 so that the sock 50 is not bent rightward or leftward.

In addition, the extended parts 11 and 12 are adjacent to each other in the valley fold part P1 (see (b) of FIG. 1). This makes it possible to (i) achieve a good balance between the extended part 11 and the extended part 12 and (ii) prevent the sock 50 from wrinkling due to its looseness on the instep side, i.e., on the valley fold side.

(Effects of Extended Parts)

The sock 50 which is worn can less wrinkle on the bend direction side of the bent part 70 by being arranged so that (i) in an entirety of the bent part 70, a part of the bent part 70 which part is located on the bend direction side (the instep side of the bent part 70) has a relatively smaller area than a part of the bent part 70 which part is located on the side (the sole side of the bent part 70) opposite from the bend direction side and (ii) on the bend direction side (the instep side of the bent part 70), a part of the bent part 70 which part is located on the bend direction side has a relatively smaller area than a part of the bent part 70 which part is located on the side opposite from the bend direction side.

The sock 50 of Embodiment 1 is arranged such that the bulging part 20 is provided on the sole side of the bent part 70, and the extended parts 11 and 12 are provided on the instep side of the bent part 70. Therefore, with the bulging part 20, on a side of the bent part 70 which side is closer, than the extended parts 11 and 12, to the side (the sole side of the bent part 70) opposite from the bend direction side, a part of the bent part 70 which part is located on the bend direction side has a relatively smaller area than a part of the bent part 70 which part is located on the side opposite from the bend direction side. Moreover, with the extended parts 11 and 12, and the bulging part 20, on a side of the bent part 70 which side is closer to the bend direction side (the instep side of the bent part 70) than the bulging part 20, a part of the bent part 70 which part is located on the bend direction side has a relatively smaller area than a part of the bent part 70 which part is located on the side opposite from the bend direction side.

Specifically, in a case where attention is focused on the left side of the sock 50, in the bent part 70 defined by the line R1 and the line R2, the number K1 of courses (not illustrated) of the valley fold part P1 that is the extended part 12 side vertex of the extended part 11 is smaller than the maximum number K3 of courses (see (b) of FIG. 1) of the extended part 11 (K1<K3). Note that the maximum number K3 of courses is smaller than the number K2 of courses of the mountain fold part P2 (the number of courses of an outer edge of the bulging part 20 which outer edge extends from the right side to the left side on the sole side, see (b) of FIG. 1). That is, the number K1 of courses is smaller than the maximum number K3 of courses, which is smaller than the number K2 of courses (K1<K3<K2).

A bend direction side vertex (the first end 110*a*) in a range (the extended part 11 and the bulging part 20) in which the number of stitches is adjusted is located on the center line S or in its vicinity.

In view of the above, the tubular foot part 310 and the tubular leg part 320 can be substantially at right angles.

Another effect will be described below with reference to (a) and (b) of FIG. 16. (a) of FIG. 16 is a view illustrating a shortest circumference S1 of a lower leg. (b) of FIG. 16 is a view illustrating a short heel circumference S2. The short heel circumference S2 is a circumferential length of a foot which circumferential length passes through (i) a point of transition from a rear surface of an ankle to a sole surface and (ii) a boundary between a front surface of the lower leg and a dorsum of the foot. As illustrated in (a) and (b) of FIG. 16, the short heel circumference S2 is greater than the shortest circumference S1 of the lower leg due to a bulge of the malleolus or the like. Thus, the sock 50 which further fits the shape of the foot can be knitted by not only merely decreasing the number of courses from the mountain fold part P2 to the valley fold part P1 but also making a difference in area between the mountain fold part side and the valley fold part side while increasing areas on the left and right sides of the bent part 70 as much as the extended parts 11 and 12.

(Design of Extended Parts)

The following description will discuss setting of the optimal number of stitches in a case where a sock is knitted by a common circular knitting machine including 144 needles.

The number of wales of each of both end parts (the first end part 110*c* and the second end part 110*d*) of the extended part 11, i.e., the increasing or decreasing number of wales is linked to the number of courses of the extended part 11. A larger number of courses of the extended part 11 allow a further decrease in number of wales from the valley fold part P1 to the sole side. Thus, a greater decrease in number of wales causes the bent part 70 to have a relatively smaller area on the instep side than on the sole side, so that the sock 50 can less wrinkle in an anterior part of an ankle joint. Note, however, that the bent part 70 is not bent in a case where the extended part 11 and the bulging part 20 (the first bulging region 21 and the second bulging region 22 in total) are equal in number of courses. This makes it necessary to cause the extended part 11 to be smaller in number of courses than the bulging part 20.

The number of courses of the extended part 11 is desirably approximately 17% of the number of wales of the circumference of the sock 50. Specifically, in the case of a common circular knitting machine including 144 needles, the number of courses of the extended part 11 is desirably 28. That is, the number of courses of the first extended region 11*p* is desirably 14, and the number of courses of the second extended region 11*q* is desirably 14. The number of courses of the extended part 11 is not limited to the above number. The number of courses of the extended part 11 can also be set so that the number of courses of the first extended region 11*p* ranges from 10 to 18 or so that the first extended region 11*p* has the minimum number of courses of not less than 2 and the maximum number of courses of not more than 36.

The maximum number W2 of wales (see (a) of FIG. 2) of the extended part 11 is desirably approximately 20% to 30% of the number of wales of the circumference of the sock 50. In addition, the minimum number W1 of wales (see (a) of FIG. 2) of the extended part 11 is desirably approximately 4% to 20% of the number of wales of the circumference of the sock 50. Specifically, in the case of a common circular knitting machine including 144 needles, the maximum number W2 of wales of the extended part 11 is desirably set in a range of 28 to 44, and the minimum number W1 of wales of the extended part 11 is desirably set in a range of 6 to 28. Note that in order that the extended part 11 is knitted so as to be better balanced, the extended part 11 desirably has the maximum number W2 of wales of 36 and the minimum number W1 of wales of 20.

The extended part 11 which has a too large number of wales is made too large, so that the sock 50 does not fit a foot. In contrast, the extended part 11 which has a too small number of wales causes the tubular foot part 310 and the tubular leg part 320 to form therebetween an angle that is larger than the right angle, so that the sock 50 does not fit the foot.

Note that the extended part 12 is set as in the case of the extended part 11. Note also that each of the number of extended parts 11 and the number of extended parts 12 can be not less than two, and the two or more extended parts 11 and the two or more extended parts 12 can be provided on courses that are in proximity to each other.

(Development)

The following description will discuss, with reference to (a) of FIG. 2, FIG. 3, and (a) and (b) of FIG. 7, a method of knitting the sock 50. (a) and (b) of FIG. 7 are views illustrating a relationship of adjacency on a left side in the development illustrated in (a) of FIG. 2.

As illustrated in (a) of FIG. 2, and (a) and (b) of FIG. 7, the sock 50 is arranged such that the foot part 31 and the leg part 32 are circumferentially knitted by use of a circular knitting machine, and the first bulging region 21, the second bulging region 22, and the extended parts 11 and 12 are knitted by reciprocating rotary knitting by use of the circular knitting machine. Further, as illustrated in the developments, the extended parts 11 and 12 are knitted between the first bulging region 21 and the second bulging region 22.

Each of lines L1 through L5 illustrated in (a) of FIG. 7 and a corresponding one of the lines L1 through L5 are sewn together via circumferentially knitted parts 40, 41, and 42. The lines L1 through L5 illustrated in (a) of FIG. 7 correspond to lines that are illustrated in (b) of FIG. 7 and given respective reference signs L1 through L5.

In each of (a) of FIG. 2 and (a) of FIG. 7, parts that are adjacent to each other in the development are knitted so as to be continuous with each other. Parts which are away from each other in the development but are adjacent to each other in the knitted sock 50 are integrated with each other by blind stitching. The "blind stitching" means that loops are cross-knitted so as to be integral with each other.

For example, in a case where the line L1 of the first bulging region 21 illustrated in (a) of FIG. 7 is joined to the line L1 of the extended part 11 via the circumferentially knitted parts 40 and 41, the first bulging region 21 and the extended part 11 are integrally knitted.

The extended parts 11 and 12, and the bulging part 20 are thus sewn together via the circumferentially knitted parts 40, 41, and 42. This allows the extended parts 11 and 12 to be knitted by use of a common circular knitting machine. Thus, a sock whose tubular foot part 310 and tubular leg part 320 are substantially at right angles can be knitted even by use of a common circular knitting machine.

Note that in a case where the extended parts 11 and 12 are provided, the sock whose tubular foot part 310 and tubular leg part 320 are substantially at right angles can also be knitted by use of a knitting machine different from a common circular knitting machine. In a case where the knitting machine different from the common circular knitting machine is used, the extended parts 11 and 12, and the bulging part 20 are sewn together via none of the circumferentially knitted parts 40, 41, and 42.

(Method of Knitting Sock 50)

The following summarizes a method, in accordance with an embodiment of the present invention, of knitting a sock 50. The method is a method of knitting, by use of a circular knitting machine including a picker, a sock 50 having at least one bent part 70, the method including the steps of: (1) knitting a first bulging region 21 which includes a region that is knitted by stitch decreasing knitting from a first end side of the sock 50 toward a second end side of the sock 50; (2) knitting an extended part 11 by continuously carrying out stitch increasing knitting and stitch decreasing knitting in this order from the first end side toward the second end side; and (3) knitting, on a side of the first bulging region 21 which side is closer to the second end side, a second bulging region 22 which includes a region that is knitted by stitch increasing knitting from the first end side toward the second end side. The extended part 11 is located so as to be closer to a bend direction side of the sock 50 than the first bulging region 21 and the second bulging region 22. The extended part has a boundary part 110 between a region that is knitted by the stitch increasing knitting carried out in the step (2) and a region that is knitted by the stitch decreasing knitting carried out in the step (2), the boundary part 110 having a bend direction side first end. In a case where the sock 50 is viewed from the bend direction side, the bend direction side first end is located on a center line S, with which the sock 50 is substantially bisected in a direction in which a width of the sock 50 extends, or within a predetermined distance from the center line S.

(Variation 1)

The following description will discuss Variation 1 of Embodiment 1 with reference to (a) and (b) of FIG. 8. (a) of FIG. 8 is a left side view of a sock 50*a* of Variation 1 of Embodiment 1. (b) of FIG. 8 is a development of the sock 50*a*. As illustrated in (a) and (b) of FIG. 8, the sock 50*a* has extended parts 11 and 12 that are provided on an opening 33 side (on a first end side) of a bulging part 20. In this case, while the sock 50*a* is being knitted, the extended parts 11 and 12 do not need to be knitted during a period between a time of knitting of a first bulging region 21 and a time of knitting of a second bulging region 22. This allows the extended parts 11 and 12 to be knitted in a tubular fabric in a knitting order according to need.

(Variation 2)

The following description will discuss Variation 2 of Embodiment 1 with reference to (a) and (b) of FIG. 9. (a) of FIG. 9 is a left side view of a sock 50*b* of Variation 2 of Embodiment 1. (b) of FIG. 9 is a development of the sock 50*b*. As illustrated in (a) and (b) of FIG. 9, the sock 50*b* has extended parts 11 and 12 that are provided on a toe part 30 side (on a second end side) of a bulging part 20. In this case, while the sock 50*b* is being knitted, the extended parts 11 and 12 do not need to be knitted during a period between a time of knitting of a first bulging region 21 and a time of knitting of a second bulging region 22. This allows the extended parts 11 and 12 to be knitted in a tubular fabric in a knitting order according to need.

(Variation 3)

The following description will discuss Variation 3 of Embodiment 1 with reference to (a) through (c) of FIG. 10. (a) of FIG. 10 is a left side view of a sock 50*c* of Variation 3 of Embodiment 1. (b) of FIG. 10 is a right side view of the sock 50*c*. (c) of FIG. 10 is a development of the sock 50*c*.

The sock 50*c* is arranged such that an extended part 11*c* and an extended part 12*c* are adjacent to each other on the left instep side (see (a) through (c) of FIG. 10). Specifically, an extended part 12*c* side end part of the extended part 11*c* is located on the left instep side, and an extended part 11*c* side end part of the extended part 12*c* is also located on the left instep side.

The extended part 11*c* and the extended part 12*c* are equal in maximum number of wales. The extended parts 11*c* and 12*c* are smaller in maximum number of wales than the extended parts 11 and 12 of Embodiment 1. Further, the extended part 12*c* has a bulging part 20 side end part that does not reach a bulging part 20.

Note that the extended part 11*c* and the extended part 12*c* can also be adjacent to each other on the right instep side. The extended part 11*c* and the extended part 12*c* only need to be adjacent to each other on the left or right instep side.

According to the sock 50*c*, a part thereof in which the extended parts 11*c* and 12*c* are adjacent to each other is a bend direction side (valley fold part side) vertex. A bent ankle joint part of a leg more bulges on a left side thereof, on which a lateral malleolus of a fibula and an astragalus are located, than on a right side thereof. By causing (i) a place in the bent ankle joint part in which place the bent ankle joint part has a wider diameter and (ii) the bend direction side vertex to coincide with each other, it is possible to prevent the sock 50*c* from wrinkling.

(Variation 4)

The following description will discuss Variation 4 of Embodiment 1 with reference to (a) through (c) of FIG. 11. (a) of FIG. 11 is a left side view of a sock 50*d* of Variation 4 of Embodiment 1. (b) of FIG. 11 is a right side view of the sock 50*d*. (c) of FIG. 11 is a development of the sock 50*d*.

The sock 50*d* is arranged such that an extended part 11*d* and an extended part 12*d* are adjacent to each other on the left instep side (see (a) and (b) of FIG. 11). Specifically, an extended part 12*d* side end part of the extended part 11*d* is located on the left instep side, and an extended part 11*d* side end part of the extended part 12*d* is also located on the left instep side.

The extended part 12*d* is larger in maximum number of wales than the extended part 11*d*. The extended part 11*d* is smaller in maximum number of wales than the extended part 11 of Embodiment 1. The extended part 12*d* has a sole side end part that is knitted between a first bulging region 21 and a second bulging region 22.

Note that the extended part 11*d* and the extended part 12*d* can also be adjacent to each other on the right instep side. The extended part 11*d* and the extended part 12*d* only need to be adjacent to each other on the left or right instep side.

According to the sock 50*d*, a part thereof in which the extended parts 11*d* and 12*d* are adjacent to each other is a bend direction side (valley fold part side) vertex. A bent ankle joint part of a leg more bulges on a left side thereof, on which a lateral malleolus of a fibula and an astragalus are located, than on a right side thereof. By causing (i) a place in the bent ankle joint part in which place the bent ankle joint part has a wider diameter and (ii) the bend direction side vertex to coincide with each other, it is possible to prevent the sock 50*d* from wrinkling. Moreover, by adjusting the maximum number of wales of each of the extended parts 11*d* and 12*d*, it is possible to knit the sock 50*d* which fits the shape of a foot.

(Variation 5)

The following description will discuss Variation 5 of Embodiment 1 with reference to (a) through (c) of FIG. 12.

(a) of FIG. 12 is a left side view of a sock 50*e* of Variation 5 of Embodiment 1. (b) of FIG. 12 is a right side view of the sock 50*e*. (c) of FIG. 12 is a development of the sock 50*e*.

The sock 50*e* is arranged such that an extended part 11*e* and an extended part 12*e* differ in maximum number of courses (see (a) and (b) of FIG. 12). According to Variation 5, the extended part 11*e* is larger in maximum number of courses than the extended part 12*e*.

According to the sock 50*e*, one of the extended parts 11*e* and 12*e* which one is larger in number of courses than the other one of the extended parts 11*e* and 12*e* has a larger area than the other one. The sock 50*e* is bent to a side on which one of the extended parts 11*e* and 12*e* which one is smaller in area than the other one is located. In view of this, for example, in a case where the extended parts 11*e* and 12*e* are adjacent to each other in a circumferential direction of the sock 50*e*, adjustment of the numbers of courses of the extended parts 11*e* and 12*e* makes it possible to easily adjust a degree of leftward or rightward bending of the sock 50*e* in accordance with where the extended parts 11*e* and 12*e* are adjacent to each other.

Embodiment 2

The following description will discuss Embodiment 2 with reference to (a) through (c) of FIG. 13. (a) of FIG. 13 is a left side view of a sock 51 in accordance with Embodiment 2. (b) of FIG. 13 is a right side view of the sock 51. (c) of FIG. 13 is a development of the sock 51. The sock 51 is provided with a single extended part 111. According to Embodiment 2, the extended part 111 has a sole side end part that is not located between a first bulging region 21 and a second bulging region 22. Note, however, that Embodiment 2 can also be arranged such that the sole side end part of the extended part 111 is located between the first bulging region 21 and the second bulging region 22.

The sock 51 which is provided with a single extended part is bent to a side on which no extended part is provided. In view of this, in a case where the extended part 111 is provided in accordance with how a right or left leg is bent, it is possible to knit a sock which fits the shape of the right or left leg.

Embodiment 3

The following description will discuss Embodiment 3 with reference to (a) through (c) of FIG. 14. (a) of FIG. 14 is a left side view of a sock 52 in accordance with Embodiment 3. (b) of FIG. 14 is a right side view of the sock 52. (c) of FIG. 14 is a development of the sock 52.

The sock 52 is arranged such that an extended part 211 and an extended part 212 are knitted on a single wale. That is, the extended part 212 is knitted so as to be adjacent to the extended part 211 and closer to a second end side of the sock 52 than the extended part 211.

Note that Embodiment 3 can be combined with Embodiment 2. Specifically, for example, a sock can be arranged to include the extended part 111 provided on a right side thereof and the extended parts 211 and 212 provided on a left side thereof.

Note that the present invention does not necessarily need to be applied to a sock. The present invention is also applicable to, for example, joint supporters such as a knee supporter and an elbow supporter. The present invention is desirably applied particularly to wear which continues to be worn while being bent at 90°. The present invention is optimally applicable to, for example, a running arm sleeve, a running knee supporter, and the like. In a case where the present invention is applied to a joint supporter, a bent part 70 covers a joint. The present invention only needs to have at least one bent part 70. The present invention can also have a plurality of bent parts 70 in accordance with to what the present invention is to be applied.

Supplementary Explanation

A tubular fabric in accordance with an embodiment of the present invention is arranged to be a tubular fabric including at least one bent part, the at least one bent part having a bulging part and at least one extended part, the bulging part having: a first bulging region which includes a region in which the number of wales, which is the number of stitches that extend in a circumferential direction of the tubular fabric, decreases from a first end side of the tubular fabric toward a second end side of the tubular fabric; and a second bulging region which is located so as to be closer to the second end side than the first bulging region and which includes a region in which the number of wales increases from the first end side toward the second end side, the first bulging region and the second bulging region each being located so as to be closer to a side opposite from a bend direction side of the tubular fabric than the at least one extended part, the at least one extended part having: a first extended region in which the number of wales increases from the first end side toward the second end side; and a second extended region which is located so as to be continuous with a side of the first extended region which side is closer to the second end side and in which from the first end side toward the second end side, the number of wales decreases from the number of wales on the side of the first extended region which side is closer to the second end side, the at least one extended part being located so as to be closer to the bend direction side than the bulging part, and the at least one extended part having a boundary part between the first extended region and the second extended region which boundary part has a bend direction side first end, and in a case where the tubular fabric is viewed from the bend direction side, the bend direction side first end being located on a center line, with which the tubular fabric is substantially bisected in a direction in which a width of the tubular fabric extends, or within a predetermined distance from the center line.

With the above arrangement, (1) the at least one extended part having: the first extended region in which the number of wales increases from the first end side of the tubular fabric toward the second end side of the tubular fabric; and the second extended region which is located so as to be continuous with the side of the first extended region which side is closer to the second end side and in which the number of wales decreases from the first end side toward the second end side is located so as to be closer to the bend direction side than (2) the bulging part having: the first bulging region which includes the region in which the number of wales decreases from the first end side toward the second end side; and the second bulging region which is located so as to be closer to the second end side than the first bulging region and which includes the region in which the number of wales increases from the first end side toward the second end side. With the above arrangement, (3) the at least one extended part has the boundary part between the first extended region and the second extended region which boundary part has the bend direction side first end, and in the case where the tubular fabric is viewed from the bend direction side, the bend direction side first end is located on the center line, with which the tubular fabric is substantially bisected in the direction in which the width of the tubular fabric extends, or within the predetermined distance from the center line. In view of these, for example, in a case where a range in which the number of wales from the center line is not more than 17% of the total number of wales of a circumference of the tubular fabric is on the center line or within the predetermined distance from the center line, the at least one extended part allows the tubular fabric to make, in a part of the bent part which part is located so as to be closer to the bend direction side than the bulging part, a difference in the number of courses between the bend direction side and the side opposite from the bend direction side.

As a result, as compared to a case where only a bulging part is knitted by use of a common circular knitting machine, it is possible in an entirety of the bent part that the part of the bent part which part is located on the bend direction side (valley fold part side) has a relatively smaller area than a part of the bent part which part is located on the side (mountain fold part side) opposite from the bend direction side. This allows the tubular fabric which is worn to less wrinkle on the bend direction side of the bent part. That is, the tubular fabric which is worn can less wrinkle on the bend direction side of the tubular fabric.

The tubular fabric in accordance with the embodiment of the present invention is preferably arranged such that the at least one extended part has a first end part which includes the bend direction side first end of the boundary part and which is shaped to be tapered from a second end of the boundary part toward the bend direction side first end of the boundary part.

The above arrangement allows the tubular fabric to make, in the part of the bent part which part is located so as to be closer to the bend direction side than the bulging part, the difference in the number of courses between the bend direction side and the side opposite from the bend direction side. It is therefore possible in the entirety of the bent part that the part of the bent part which part is located on the bend direction side has the relatively smaller area than the part of the bent part which part is located on the side opposite from the bend direction side. This allows the tubular fabric which is worn to less wrinkle on the bend direction side of the bent part.

The tubular fabric in accordance with the embodiment of the present invention is preferably arranged such that the at least one extended part has a second end part which includes the second end of the boundary part and which is shaped to be tapered from the bend direction side first end of the boundary part toward the second end of the boundary part.

The above arrangement makes it easy to provide the at least one extended part in a plane without being bulged between the first bulging region and the second bulging region.

The tubular fabric in accordance with the embodiment of the present invention is preferably arranged such that the first end part has a central angle of approximately 90°, the central angle being formed between two sides connected at the bend direction side first end of the boundary part.

With the above arrangement, for example, a sock can be knitted so that a first part of the sock which first part surrounds a foot part and a second part of the sock which second part surrounds a lower leg part are substantially at right angles. This allows the sock to fit the shape of a foot and to less wrinkle in an anterior part of an ankle joint. The above arrangement also makes it possible to equalize the number of wales of the first part to that of the second part in a knitted tubular fabric, so that the knitted tubular fabric has a beautiful appearance.

The tubular fabric in accordance with the embodiment of the present invention is preferably arranged such that: the at least one extended part has a maximum number of wales which maximum number is 20% to 30% of the number of wales of a circumference of the tubular fabric; and the at least one extended part has a minimum number of wales which minimum number is 4% to 20% of the number of wales of the circumference of the tubular fabric.

The above arrangement makes it possible to optimally knit the at least one extended part.

The tubular fabric in accordance with the embodiment of the present invention is preferably arranged such that the second end of the boundary part is located between the first bulging region and the second bulging region.

With the above arrangement, the bend direction side first end of the boundary part substantially coincides with an intersection of (i) a side of the bulging part which side is located on the first end side of the tubular fabric and extended in a bend direction of the bent part and (ii) a side of the bulging part which side is located on the second end side of the tubular fabric and extended in the bend direction. Therefore, the at least one extended part is provided on the bend direction side which is located so as to be symmetrical to a vertex opposite from a bend direction side vertex and on which the tubular fabric which is worn is likely to wrinkle. This allows the tubular fabric to yet less wrinkle.

The tubular fabric in accordance with the embodiment of the present invention is preferably arranged such that the at least one extended part includes a plurality of extended parts.

With the above arrangement, optional provision of the plurality of extended parts makes it possible to knit a tubular fabric which fits the shape of an object which is to be put in the tubular fabric.

The tubular fabric in accordance with the embodiment of the present invention is preferably arranged such that the plurality of extended parts is knitted so as to be adjacent to each other in the circumferential direction of the tubular fabric.

With the above arrangement, the plurality of extended parts is adjacent to each other in the circumferential direction of the tubular fabric across the center line. Due to the plurality of extended parts which is adjacent as such, a part of the bent part which part is located on the bend direction side can have a smaller area than a part of the bent part which part is located on the side opposite from the bend direction side. Therefore, the tubular fabric which is worn can less wrinkle on the bend direction side of the bent part.

The tubular fabric in accordance with the embodiment of the present invention is preferably arranged such that the plurality of extended parts is knitted so as to be adjacent to each other in a longer side direction of the tubular fabric.

The above arrangement increases an area of a place in which the plurality of extended parts is knitted so as to be adjacent to each other, and one of the plurality of extended parts is closer to the second end side of the tubular fabric than the other(s) of the plurality of extended parts. Therefore, by providing the plurality of extended parts in intended places, it is possible to knit a tubular fabric which fits the shape of an object which is to be put in the tubular fabric.

A sock in accordance with an embodiment of the present invention is preferably arranged to be made of the tubular fabric.

The above arrangement makes it possible to provide a sock (i) whose bulging part fits a heel and (ii) which can less wrinkle in an anterior part of an ankle joint on the bend direction side of the bent part.

A method, in accordance with an embodiment of the present invention, of knitting a tubular fabric is a method of knitting, by use of a circular knitting machine including a picker, a tubular fabric having at least one bent part, the method including the steps of: a) knitting a first bulging region which includes a region that is knitted by stitch decreasing knitting from a first end side of the tubular fabric toward a second end side of the tubular fabric; b) knitting an extended part by continuously carrying out stitch increasing knitting and stitch decreasing knitting in this order from the first end side toward the second end side; and c) knitting, on a side of the first bulging region which side is closer to the second end side, a second bulging region which includes a region that is knitted by stitch increasing knitting from the first end side toward the second end side, the extended part being located so as to be closer to a bend direction side of the tubular fabric than the first bulging region and the second bulging region, and the extended part having a boundary part between a region that is knitted by the stitch increasing knitting carried out in the step b) and a region that is knitted by the stitch decreasing knitting carried out in the step b), the boundary part having a bend direction side first end, and in a case where the tubular fabric is viewed from the bend direction side, the bend direction side first end being located on a center line, with which the tubular fabric is substantially bisected in a direction in which a width of the tubular fabric extends, or within a predetermined distance from the center line.

The present invention is not limited to the embodiments, but can be altered by a skilled person in the art within the scope of the claims. An embodiment derived from a proper combination of technical means each disclosed in a different embodiment is also encompassed in the technical scope of the present invention.

Reference Signs List

11, 11*c*, 11*d*, 11*e*, 12, 12*c*, 12*d*, 12*e*, 111, 211, and 212: extended part (extended part)
11*p*: first extended region
11*q*: second extended region
20, 20*a*, 20*b*, and 20*c*: bulging part
21, 21*a*, 21*b*, and 21*c*: first bulging region
22, 22*a*, 22*b*, and 22*c*: second bulging region
30: toe part
33: opening
50, 50*a*, 50*b*, 50*c*, 50*d*, 50*e*, 51, 52, 60, 61, and 62: sock
70: bent part
110: boundary part
110*c*: first end part
110*d*: second end part
θ1: bend angle
θ2: central angle
S: center line

The invention claimed is:

1. A tubular fabric comprising at least one bent part, the at least one bent part having a bulging part and at least one extended part, the bulging part having:

a first bulging region which includes a region in which the number of wales, which is the number of stitches that extend in a circumferential direction of the tubular fabric, decreases from a first end side of the tubular fabric toward a second end side of the tubular fabric; and a second bulging region which is located so as to be closer to the second end side than the first bulging region and which includes a region in which the number of wales increases from the first end side toward the second end side, the first bulging region and the second bulging region each being located so as to be closer to a side opposite from a bend direction side of the tubular fabric than the at least one extended part, the at least one extended part having:

a first extended region in which the number of wales increases from the first end side toward the second end side; and a second extended region which is located so as to be continuous with a side of the first extended region which side is closer to the second end side and in which from the first end side toward the second end side, the number of wales decreases from the number of wales on the side of the first extended region which side is closer to the second end side, the at least one extended part being located so as to be closer to the bend direction side than the bulging part, and the at least one extended part having a boundary part between the first extended region and the second extended region which boundary part has a bend direction side first end, and in a case where the tubular fabric is viewed from the bend direction side, the bend direction side first end being located on a center line, with which the tubular fabric is substantially bisected in a direction in which a width of the tubular fabric extends, or within a predetermined distance from the center line.

2. The tubular fabric as set forth in claim 1, wherein the at least one extended part has a first end part which includes the bend direction side first end of the boundary part and which is shaped to be tapered from a second end of the boundary part toward the bend direction side first end of the boundary part.

3. The tubular fabric as set forth in claim 2, wherein the at least one extended part has a second end part which includes the second end of the boundary part and which is shaped to be tapered from the bend direction side first end of the boundary part toward the second end of the boundary part.

4. The tubular fabric as set forth in claim 2, wherein the first end part has a central angle of approximately 90°, the central angle being formed between two sides connected at the bend direction side first end of the boundary part.

5. The tubular fabric as set forth in claim 1, wherein the at least one extended part has a maximum number of wales which maximum number is 20% to 30% of the number of wales of a circumference of the tubular fabric; and the at least one extended part has a minimum number of wales which minimum number is 4% to 20% of the number of wales of the circumference of the tubular fabric.

6. The tubular fabric as set forth in claim 1, wherein the second end of the boundary part is located between the first bulging region and the second bulging region.

7. The tubular fabric as set forth in claim 1, wherein the at least one extended part comprises a plurality of extended parts.

8. The tubular fabric as set forth in claim 7, wherein the plurality of extended parts is knitted so as to be adjacent to each other in the circumferential direction of the tubular fabric.

9. The tubular fabric as set forth in claim 7, wherein the plurality of extended parts is knitted so as to be adjacent to each other in a longer side direction of the tubular fabric.

10. A sock being made of a tubular fabric recited in claim 1.

11. A method of knitting, by use of a circular knitting machine including a picker, a tubular fabric having at least one bent part, the method comprising the steps of:

a) knitting a first bulging region which includes a region that is knitted by stitch decreasing knitting from a first end side of the tubular fabric toward a second end side of the tubular fabric;

b) knitting an extended part by continuously carrying out stitch increasing knitting and stitch decreasing knitting in this order from the first end side toward the second end side; and c) knitting, on a side of the first bulging region which side is closer to the second end side, a second bulging region which includes a region that is knitted by stitch increasing knitting from the first end side toward the second end side, the extended part being located so as to be closer to a bend direction side of the tubular fabric than the first bulging region and the second bulging region, and the extended part having a boundary part between a region that is knitted by the stitch increasing knitting carried out in the step b) and a region that is knitted by the stitch decreasing knitting carried out in the step b), the boundary part having a bend direction side first end, and in a case where the tubular fabric is viewed from the bend direction side, the bend direction side first end being located on a center line, with which the tubular fabric is substantially bisected in a direction in which a width of the tubular fabric extends, or within a predetermined distance from the center line.

* * * * *